US010332322B2

(12) United States Patent
Nix

(10) Patent No.: US 10,332,322 B2
(45) **Date of Patent: *Jun. 25, 2019**

(54) SYSTEMS AND METHODS FOR VEHICLE-TO-VEHICLE COMMUNICATION

(71) Applicant: Harman International Industries, Incorporated, Stamford, CT (US)

(72) Inventor: Axel Nix, Birmingham, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/799,420

(22) Filed: Oct. 31, 2017

(65) Prior Publication Data

US 2018/0068496 A1 Mar. 8, 2018

Related U.S. Application Data

(63) Continuation of application No. 15/087,876, filed on Mar. 31, 2016, now Pat. No. 9,852,554.

(51) Int. Cl.
*G07C 5/00* (2006.01)
*G07C 5/08* (2006.01)
(Continued)

(52) U.S. Cl.
CPC ..... *G07C 5/008* (2013.01); *G07C 5/08* (2013.01); *G08G 1/163* (2013.01); *G08G 1/166* (2013.01); *G08G 1/22* (2013.01)

(58) Field of Classification Search
CPC . G07C 5/008; G07C 5/08; G07C 5/02; G08G 1/161; G08G 1/22; G08G 1/163
See application file for complete search history.

(56) References Cited

U.S. PATENT DOCUMENTS 7,425,903 B2 9/2008 Boss et al.
9,036,026 B2 5/2015 Dellantoni et al.
(Continued)

FOREIGN PATENT DOCUMENTS

JP 2011209849 A 10/2011
WO 2010099416 A1 9/2010

OTHER PUBLICATIONS

Casimiro, A. et al., "A Kernel-based Architecture for Safe Cooperative Vehicular Functions," Proceedings of the 2014 9th IEEE International Symposium on Industrial Embedded Systems, Aug. 7, 2014, Pisa, Italy, 10 pages.
(Continued)

*Primary Examiner* — Michael J Zanelli
(74) *Attorney, Agent, or Firm* — McCoy Russell LLP

(57) ABSTRACT

Systems and method for vehicle-to-vehicle communication are provided. In one example, a vehicle system may include one or more sub-systems, an in-vehicle computing system, and an inter-vehicle communication system. The in-vehicle computing system may be configured to generate and/or update trust scores for the one or more sub-systems based on a functional safety classification of the one or more sub-systems. The trust scores may be transmitted to one or more other vehicles near the vehicle via the inter-vehicle communication system. The in-vehicle computing system may also receive trust scores from the one or more other vehicles. Based on the received trust scores, the in-vehicle computing system may adjust longitudinal and/or lateral control of the vehicle via one or more actuators.

17 Claims, 12 Drawing Sheets

(51) Int. Cl.
*G08G 1/00* (2006.01)
*G08G 1/16* (2006.01)

(56) References Cited

U.S. PATENT DOCUMENTS

| | | | |
|---|---|---|---|
| 2010/0019891 | A1 | 1/2010 | Mudalige |
| 2013/0030688 | A1 | 1/2013 | Shimizu et al. |
| 2015/0146754 | A1 | 5/2015 | Werkstetter |
| 2015/0264321 | A1 | 9/2015 | Dellantoni et al. |
| 2016/0042238 | A1 | 2/2016 | Lynam et al. |
| 2016/0373449 | A1 | 12/2016 | Haga et al. |

OTHER PUBLICATIONS

Meroth, A. et al., "Functional Safety and Development Process Capability for Intelligent Transportation Systems," IEEE Intelligent Transportation Systems Magazine, vol. 7, No. 4, Jun. 18, 2014, 12 pages.

European Patent Office, Extended European Search Report Issued in Application NO. 17159322.1, Sep. 20, 2017, Germany, 8 pages.

SYSTEMS AND METHODS FOR VEHICLE-TO-VEHICLE COMMUNICATION

CROSS REFERENCE TO RELATED APPLICATIONS

The present application is a continuation of U.S. patent application Ser. No. 15/087,876, entitled "SYSTEMS AND METHODS FOR VEHICLE-TO-VEHICLE COMMUNICATION," filed on Mar. 31, 2016, the entire contents of which are hereby incorporated by reference in their entirety for all purposes.

FIELD

The disclosure relates to the field of vehicle-to-vehicle communication, and in particular, to monitoring vehicle operation during vehicle-to-vehicle communication.

BACKGROUND

Driver assistance systems may be configured to assist a driver in controlling a vehicle, in identifying other vehicles and driving hazards, and in managing multiple vehicle systems simultaneously. Driver assistance systems employ one or more sensors such as radar sensors, lidar sensors, and machine vision cameras, which serve to identify the road and/or lane ahead, as well as objects such as other cars or pedestrians around the vehicle, especially those in the path of a host vehicle. Upon identifying objects in a driving path, driver assistance systems may provide a warning to the driver and/or take temporary control of vehicle systems such as steering and braking systems, and may perform corrective and/or evasive maneuvers.

Further, driver assistance systems may increase assistance to the driver by establishing vehicle-to-vehicle communication between the vehicle and one or more other vehicles to communicate about any emergency ahead and/or other information, thus improving vehicle and road safety.

Overall, driver assistance systems may be configure to improve a driver's experience by reducing the burden of operating a vehicle, and by providing detailed information about the vehicle's environment that may not otherwise be apparent to the driver.

SUMMARY

Embodiments are disclosed for a vehicle system for generating and broadcasting trust scores. An example vehicle system includes one or more sub-systems including one or more components. An inter-vehicle communication system is configured to receive and transmit information between the vehicle and one or more other vehicles. An in-vehicle computing system includes a processor and a storage device. The storage device stores functional safety classification data and instructions executable by the processor. The processor may determine trust scores of the one or more sub-systems based on a functional safety classification of the sub-system. The processor may store the determined trust score in the storage device. The processor may broadcast the trust scores of the one or more sub-systems to the one or more other vehicles via the inter-vehicle communication system.

Embodiments are also disclosed for a vehicle system for receiving trust scores. An example vehicle system includes one or more sub-systems including one or more sensors and one or more actuators. An inter-vehicle communication system is configured to receive and transmit information between the vehicle and a second vehicle. An in-vehicle computing system includes a processor and a storage device. The storage device stores a first trust score data including a first trust score for the one or more sub-systems and instructions executable by the processor. The processor may receive a second trust score data from the second vehicle via the inter-vehicle communication system. The second trust score data may include a second trust score for one or more second sub-systems of the second vehicle. The processor may adjust one or more actuators of the vehicle system based on the received second trust score data. The first trust score and the second trust score are based on functional safety classifications of the one or more sub-systems and the one or more second sub-systems respectively.

Further, methods are disclosed for a driver assistance system. An example method for an advanced driver assistance system for a vehicle includes receiving a trust score data from a first leading vehicle operating in a same lane as the vehicle. The trust score data may include a first trust score for a first sub-system of the first leading vehicle. During a first condition when the first trust score is greater than a threshold, the method may include adjusting one or more actuators of the vehicle to maintain a first threshold separation between the vehicle and the first vehicle. During a second condition when the first trust score is less than the threshold, the method may include adjusting the one or more actuators of the vehicle to maintain a second threshold separation between the vehicle and the first vehicle. The first trust score is based on a functional safety classification of the first sub-system. The first threshold separation is shorter than the second threshold separation.

It is to be understood that the features mentioned above and those to be explained below can be used not only in the respective combinations indicated, but also in other combinations or in isolation. These and other objects, features, and advantages of the disclosure will become apparent in light of the detailed description of the embodiment thereof, as illustrated in the accompanying drawings.

BRIEF DESCRIPTION OF THE DRAWINGS

The disclosure may be better understood from reading the following description of non-limiting embodiments, with reference to the attached drawings, wherein below.

DETAILED DESCRIPTION

Figure 1:
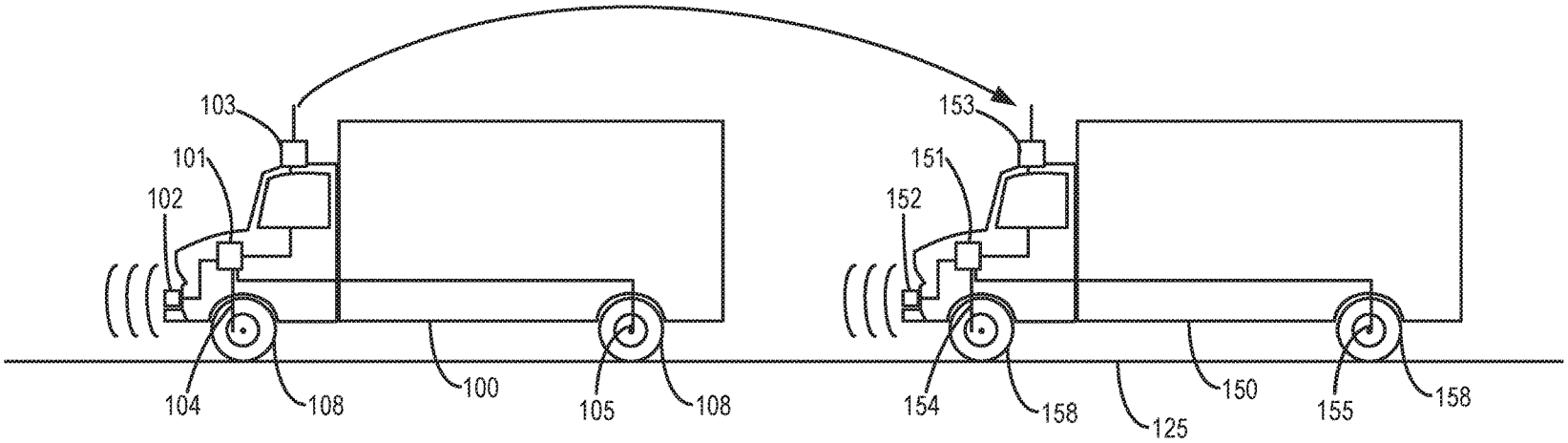
FIG. 1 shows an example vehicle-to-vehicle communication in accordance with one or more embodiments of the present disclosure.

As described above, automobiles may be configured with Advanced Driver Assistance Systems (ADAS systems) to support the driver and automate driving tasks. An ADAS system may comprise a sensing system that includes radar sensors and/or lidar sensors. The radar and/or lidar based sensing system may be configured to transmit a signal, receive a reflected signal, and analyze the transmitted and received reflected signals to sense one or more objects in the driving path and determine if the distance between the vehicle and the object is increasing or decreasing. The ADAS system may also comprise a camera-based sensing system that includes one or more machine-vision cameras. The camera-based sensing system may be configured to detect objects in the driving path and estimate a distance between the vehicle and the objects based on analysis of images captured by the machine-vision cameras. Detected objects may be vehicles, pedestrians, lane markings, traffic signs, traffic lights, pot holes, and speed bumps, for example. Utilizing these advanced driver assistance sensing systems, the ADAS system may warn a driver who is drifting out of the lane or about to collide with a preceding vehicle. ADAS systems may also assume control of the vehicle, for example, by applying brakes to avoid or mitigate an impending collision or applying torque to the steering system to prevent the host vehicle from drifting out of the lane. ADAS systems may assume control of the vehicle temporarily, for example, to avoid an impending collision, or over longer periods of time, such as while driving in a traffic jam or on a road segment that has been authorized for autonomous driving operation.

More recently, ADAS systems may be utilized in cooperation with vehicle-to-vehicle communication systems that extend the range of object detection and awareness of an environment of the vehicle by utilizing information, such as traffic, road conditions, surrounding vehicle position, etc., broadcasted from one or more vehicles in the neighborhood of the vehicle.

However, all of the above systems suffer from a significant lag in detecting a hazardous situation. For example, a hazardous situation may occur when a critical part or a safety critical system on a preceding vehicle fails. The failure may cause the preceding vehicle to unexpectedly slow from a cruising speed to a stopped condition, thereby causing a sudden decrease in space cushion between the preceding vehicle and a trailing vehicle, which may eventually result in a collision. All of the above systems detect the slowing that resulted from the critical part failure. That is, all of the above systems detect the observable effects resulting from the failure and not the actual failure. As a result, there is a significant lag between a time point of failure and a time point of detection of the observable effects of failure. The lag may not allow sufficient time for the ADAS system or the driver to take a desirable preventive action.

Further, during vehicle-to-vehicle communication, the trailing vehicle constantly relies on outputs from systems within the leading vehicle, such as vehicle position output from a navigation system of the leading vehicle. However, the data transmitted by the leading vehicle does not indicate a reliability of the data transmitted by the leading vehicle. Further, the reliability cannot be ascertained merely based on an output (e.g., vehicle position) without information regarding the development or current functional efficiency or performance of systems within the leading vehicle.

This disclosure provides systems and methods for generating a trust score for each sub-system within a vehicle system, the trust score indicating a reliability of the sub-system. The trust score may be based on a functional safety classification of the sub-system and/or individual components comprising the sub-system. The functional safety classification may be based on a functional safety standard, such as ISO 26262, for example. The functional safety classification may provide an indication of functional safety standards employed during development and production of each sub-system within the vehicle and/or individual components of each sub-system. In that case the trust score for a given vehicle system or vehicle component is determined during development of the subsystem or component and may not change over time.

Further, systems and methods are provided for updating the generated trust score for each sub-system of the vehicle during vehicle operation based on an observed failure-free use of the subsystem in vehicles. For example, a vehicle subsystem may be assigned an initial, lower trust score when the sub-system is first launched in vehicles. After vehicles with the installed sub-system have operated without failure for a predetermined amount of time, e.g., 10 million hours of accumulated subsystem operation in the total vehicle fleet, the trust score of the sub-system may be increased. The updated trust score for each sub-system may be broadcasted via a vehicle-to-x communication system along with a sub-system operating status and sub-system operating parameter. The vehicle-to-x communication system may be a dedicated short range communication system (DSRC) for direct vehicle to vehicle communication. The trust score may provide an indication of reliability of information or data output by each sub-system within the vehicle.

The broadcasted trust scores may be received by one or more other vehicles within a threshold radius via the vehicle-to-vehicle communication system, and the received trust scores may be utilized by the receiving vehicle to determine a control action (e.g., increase space cushion, change lanes, etc.). Since the trust scores are based on a functional safety standard, trust scores provide a basis for comparison of data transmitted by different vehicles developed by different manufacturers. As a result, reliability and quality of vehicle-to-vehicle communication is increased.

Further, the broadcasted data may include sub-system operating status and sub-system operating parameters along with sub-system trust score indicating reliability of the operating status and parameter. In an exemplary use-case, two vehicles may follow each other closely in a platoon. The headway between the leading vehicle and the trailing vehicle in a platoon can be decreased, if the leading vehicle communicates its current acceleration to the trailing vehicle. This is particularly important when the leading vehicle initiates sharp deceleration. Due to latencies inherent to sensing systems, the trailing vehicle can detect such a sharp deceleration only after the leading vehicle has begun to decelerate—which due to inherent latencies in brake systems is after the leading vehicle has initiated the deceleration. Communicating the upcoming deceleration before the trailing vehicle can detect it allows the desired reduction in headway, but requires that the trailing vehicle can rely on a) receiving the information from the leading vehicle and b) trusting that the information received from the leading vehicle is correct and timely. "Trust" in the information received from the leading vehicle is not necessarily a binary attribute (trust/do not trust) but a quantifiable metric. The trailing vehicle may decide "how much" to trust the information received from the leading vehicle. For example, the trailing vehicle may take one or more control actions based on the information received from the vehicle and a level of trust in the information received. The level of trust may be based on a risk associated with trusting the information received from the tailing vehicle. The risk may include a probability of a hazardous event (e.g., a fender-bender or a serious accident) and/or an extent of damage if the information received turns out to be false.

The level of trust in information received from the leading vehicle may be reflected in a trust score and will depend on several factors. For example, the level of trust or trust score will depend on how the leading vehicle derived its information. Was the information derived from a single sensor which has a given failure rate, or was it independently derived from two sensors, which are much less likely to both fail simultaneously? How much diligence did the developers of the leading vehicle use when creating and testing the system? Did they anticipate the information to be used in potentially life-threatening use-cases? ISO Standard 26262 establishes practices for developing electronic systems that require functionally safety. The present disclosure provides solutions to extend the concept of functional safety beyond a single vehicle, the design of which can be overseen by a single entity such as a carmaker, to include multiple vehicles designed by different entities.

FIG. 1 illustrates a vehicle-to-vehicle communication system in use. A leading vehicle 100 is followed by in close proximity by a trailing vehicle 150. Each vehicle includes a sensor 102, 152. The sensor 102, 152 may be, for example, a long-range radar sensor for detecting objects in front of the vehicle 100, 150. The sensor 102, 152 is operatively connected to and communicates with an in-vehicle computing system 101, 151. The in-vehicle computing system 101, 151 is operatively connected to and controls one or more actuators, e.g., a brake 104, 154 and a drivetrain 105, 155 of the respective vehicle to affect the longitudinal movement of the vehicle 100, 150. Drivetrain 105, 155 is shown coupled to drive wheels 108, 158 of the respective vehicles, which may contact a road surface 125.

While the present example shows in-vehicle computing system 101, 151 communicating with the sensor 102, 152 and the brake 104, 154 and the drivetrain 105, 155, it will be appreciated that the in-vehicle computing system 101, 151 may receive information from a plurality of sensors and may send control signals to a plurality of actuators of the respective vehicle. In-vehicle computing system 101, 151 may include one or more controllers (not shown). The controllers may receive input data from the various sensors, process the input data, and trigger the actuators in response to the processed input data based on instruction or code programmed therein corresponding to one or more routines. Example routines are illustrated with respect to FIGS. 6-9, 10A and 10B.

The in-vehicle computing system 101, 151 is operatively connected to an inter-vehicle communication system 103, 153. The inter-vehicle communication system 103, 153 is configured to receive and transmit information between the vehicles 100, 150. In particular, the leading vehicle 100 may communicate through its inter-vehicle communication system 103, vehicle operation data such as brake pressure, requested deceleration, actual deceleration, vehicle speed, and objects detected by sensor 102 to the trailing vehicle 150 through its inter-vehicle communication system 153. Further, the leading vehicle 100 may also communicate trust scores associated with the vehicle operation data along with the vehicle operation data. The trust scores for the vehicle operation data may be based on a functional safety classification of components (e.g., sensors, actuators, etc.) or sub-systems comprising one or more components that determine the vehicle operation data. For example, the leading vehicle 100 may communicate information regarding objects detected by sensor 102 along with a trust score for sensor 102, where the trust score for sensor 102 may be determined based on a functional safety classification of sensor 102.

The Functional safety classification may be based on a functional safety standard, such as ISO 26262, which establishes protocols for allocating functional safety requirements for vehicle components and/or sub-systems. Based on the functional safety requirements, the components and/or sub-systems may be developed and validated. Thus, the functional safety classification of a component or a sub-system provides an indication of functional safety standards according to which the component or the sub-system was developed and validated. For example, if a component or a sub-system is accredited with a highest functional safety classification, it indicates that highest degrees of diligence (e.g., most stringent safety measures to minimize potential failure that may lead to a hazardous situation during operation of the component or sub-system) were employed during the development and validation of the component or sub-system. Thus, the component or sub-system with the highest functional safety classification may have the highest trustworthiness compared to a component or sub-system with a lower functional safety classification. Trust score provided in the present disclosure is based on the functional safety classification. Therefore, the trust score indicates a trustworthiness of the component or sub-system. Therefore, a trust score for a component or a sub-system with higher functional safety classification may be greater than a trust score for a component or a sub-system with a lower functional safety classification indicating that the component or sub-system with the higher trust score is more reliable than the component or sub-system with the lower trust score. Consequently, a vehicle operation data that is based on the component or sub-system with the higher trust score is more reliable than a vehicle operation data that is based on the component or sub-system with the lower trust score.

Returning to FIG. 1, based on the communicated trust scores and the vehicle operation data, the trailing vehicle 150 may take one or more control decisions (e.g., whether to continue following the leading vehicle, whether to increase a separation between the vehicles, etc.). For example, if a trust score for the sensor 102 is below a threshold, the trailing vehicle may not trust the data from the sensor 102 and may adjust brake 154 and/or drivetrain 155 to increase the separation between the leading vehicle 100 and trailing vehicle 150.

Further, the trust scores based on functional safety may provide a standard for determining trustworthiness of data when two vehicles engaged in a vehicle-to-vehicle communication were developed by different manufacturers. In this way, by communicating trust score along with vehicle operation data, coordinated driving may be achieved between vehicles developed by same manufacturers as well as different manufacturers.

Figure 2:
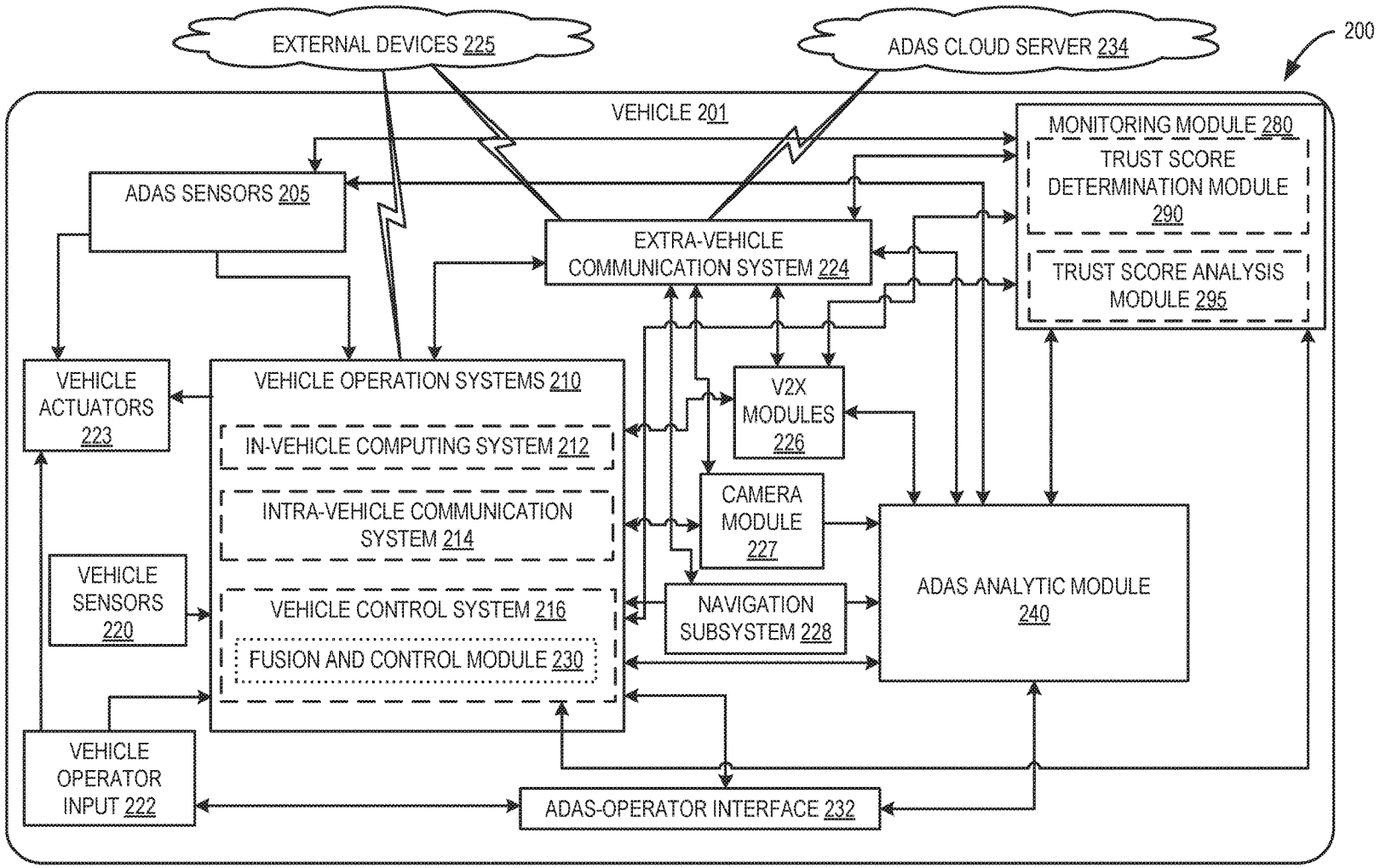
FIG. 2 shows a block diagram of an advanced driver assistance system in accordance with one or more embodiments of the present disclosure.

FIG. 2 is a block diagram illustration of an example advanced driver assistance system (ADAS) 200. ADAS 200 may be configured to provide driving assistance to an operator of vehicle 201, which may be an example of vehicle 100 and/or 150 shown at FIG. 1. For example, ADAS 200 may be configured to adjust longitudinal control and/or lateral control of vehicle 201 based on inputs from on-board sensors including ADAS sensors 205 and vehicle sensors 220, and/or data received via vehicle-to-X communication from one or more other vehicles travelling in the vicinity of vehicle 201.

ADAS sensors 205 may be installed on or within vehicle 201. ADAS sensors 205 may be configured to identify the road and/or lane ahead of vehicle 201, as well as objects such as cars, pedestrians, obstacles, road signs, traffic signs, traffic lights, potholes, speed bumps etc. in the vicinity of vehicle 201. ADAS sensors 205 may include, but are not limited to, radar sensors, lidar sensors, ladar sensors, ultrasonic sensors, machine vision cameras, as well as position and motion sensors, such as accelerometers, gyroscopes, inclinometers, and/or other sensors.

Vehicle sensors 220 may include engine parameter sensors, battery parameter sensors, vehicle parameter sensors, fuel system parameter sensors, ambient condition sensors, cabin climate sensors, etc. Vehicle sensors 220 may also include vehicle speed sensors, wheel speed sensors, steering angle sensors, yaw rate sensors, and acceleration sensors.

Vehicle 201 may include vehicle operation systems 210, including in-vehicle computing system 212, intra-vehicle computing system 214, and vehicle control system 216. In-vehicle computing system 212 may be an example of in-vehicle computing systems 101 and/or 151. Intra-vehicle communication system 214 may be may be configured to mediate communication among the systems and subsystems within vehicle 201. Vehicle control system 216 may include controls for adjusting the settings of various vehicle controls (or vehicle system control elements) related to the engine and/or auxiliary elements within a cabin of the vehicle, such as steering wheel controls (e.g., steering wheel-mounted audio system controls, cruise controls, windshield wiper controls, headlight controls, turn signal controls, etc.), brake controls, lighting controls (e.g., cabin lighting, external vehicle lighting, light signals) as well as instrument panel controls, microphone(s), accelerator/clutch pedals, a gear shift, door/window controls positioned in a driver or passenger door, seat controls, audio system controls, cabin temperature controls, etc. The vehicle controls may also include internal engine and vehicle operation controls (e.g., engine controller module, actuators, valves, etc.) that are configured to receive instructions via a controller area network (CAN) bus of the vehicle to change operation of one or more of the engine, exhaust system, transmission, and/or other vehicle system.

Vehicle operation systems 210 may receive input and data from numerous sources, including ADAS sensors 205 and vehicle sensors 220. Vehicle operation systems 210 may further receive vehicle operator input 222, which may be derived from a user interface, such as ADAS-operator interface 232, and/or through the vehicle operator interacting with one or more vehicle actuators 223, such as a steering wheel, gas/brake/accelerator pedals, gear shift, etc.

Extra-vehicle communication system 224 may enable vehicle-operating systems 210 to receive input and data from external devices 225 as well as devices coupled to vehicle 201 that require communication with external devices 225, such as V2X 226, camera module 227, and navigation subsystem 228. Extra-vehicle communication system 224 may comprise or be coupled to an external device interface and may additionally or alternatively include or be coupled to an antenna.

External devices 225 may include a mobile device (e.g., connected via a Bluetooth, NFC, WIFI direct, or other wireless connection) or an alternate Bluetooth-enabled device. Other external devices include external storage devices, such as solid-state drives, pen drives, USB drives, etc. Information exchanged with external devices 225 may be encrypted or otherwise adjusted to ensure adherence to a selected security level. In some embodiments, information may only be exchanged after performing an authentication process and/or after receiving permission from the sending and/or received entity.

External devices 225 may include one or more V2X services, which may provide data to V2X modules 226. V2X modules 226 may include vehicle-to-vehicle (V2V) modules as well as vehicle-to-infrastructure (V2I) modules. V2X modules 226 may receive information from other vehicles/in-vehicle computing systems in other vehicles via a wireless communication link (e.g., Dedicated Short Range Communication (DSRC), BLUETOOTH, WIFI/WIFI-direct, near-field communication, etc.). V2X modules 226 may further receive information from infrastructure present along the route of the vehicle, such as traffic signal information (e.g., indications of when a traffic light is expected to change and/or a light changing schedule for a traffic light near the location of the vehicle).

External devices 225 may include one or more camera services, which may provide data to camera module 227. A camera service may provide data from, and/or facilitate communication with cameras external to vehicle 201, such as cameras in other vehicles, traffic cameras, security cameras, etc. Similarly, camera module 227 may export data received from one or more cameras mounted to vehicle 201 to external camera services.

External devices 225 may include one or more navigation services, which may provide data to navigation subsystem 228. Navigation subsystem 228 may be configured to receive, process, and/or display location information for the vehicle, such as a current location, relative position of a vehicle on a map, destination information (e.g., a final/ultimate destination), routing information (e.g., planned routes, alternative routes, locations along each route, traffic and other road conditions along each route, etc.), as well as additional navigation information.

As part of ADAS system 200, vehicle control system 216 may include fusion and control module 230. Fusion and control module 230 may receive data from ADAS sensors 205, as well as vehicle sensors 220, vehicle operator input 222, V2X modules 226, camera module 227, navigation subsystem 228, other sensors or data sources coupled to vehicle 201, and/or via extra-vehicle communication system 224. Fusion and control module 230 may validate, parse, process, and/or combine received data, and may determine control actions in response thereto. In some scenarios, fusion and control module 230 may provide a warning to the vehicle operator via ADAS-operator interface 232. ADAS-operator interface 232 may be incorporated into a generic user interface within the vehicle. For example, a warning may comprise a visual warning, such as an image and/or message displayed on a touch-screen display or dashboard display, or via a see-through display coupled to a vehicle windshield and/or mirror. In some examples, an audible warning may be presented via the vehicle audio system, such as an alarm or verbalized command. In some examples, a warning may comprise other means of alerting a vehicle operator, such as via a haptic motor (e.g., within the vehicle operator's seat), via the vehicle lighting system, and/or via one or more additional vehicle systems.

In some scenarios, fusion and control module 230 may take automatic action via vehicle actuators 223 if the vehicle operator appears inattentive, or if immediate action is indicated. For example, fusion and control module 230 may output a signal to a vehicle steering system responsive to an indication that the vehicle drifting out of a traffic lane, or may output a signal to a vehicle braking system to initiate emergency braking if the received sensor data indicates the presence of an object ahead of and in the path of vehicle 201.

In some examples, fusion and control module 230 may take an automatic action via vehicle actuators 223 (e.g., braking actuators, drivetrain actuators, steering actuators) to adjust longitudinal and lateral control of vehicle 201 based on vehicle operation data and associated trust score data received from one or more other vehicles communicating with vehicle 201 via extra-vehicle communication system 224. For example, in response to at least a first trust score of a first sensor (e.g., distance sensor) of a second vehicle travelling in front of the vehicle and communicating with the vehicle being below a threshold score, fusion and control module 230 may adjust one or more braking actuators and/or one or more drive train actuators of vehicle 201 to increase a distance between vehicle 201 and the second vehicle.

ADAS-operator interface 232 may be a module or port for receiving user input from a user input device connected to the fusion and control module, from a touch-sensitive display, via a microphone, etc. In some examples, the vehicle operator may request to cede control of the vehicle for a duration via ADAS-operator interface 232. Fusion and control module 230 may then take over control of all or a subset of vehicle actuators 223 in order to allow the vehicle operator to focus on other tasks than driving. In such scenarios, fusion and control module 230 may assume lateral and longitudinal control of the vehicle, for example while driving in traffic jams at relatively low speed. As the underlying algorithms improve, fusion and control module 230 may take over control of the vehicle in increasing varieties of scenarios and locations. Road segments that are authorized for autonomous operation may be encoded in the navigation subsystem 228 and communicated to the fusion and control module 230.

ADAS analytics module 240 may receive information from ADAS sensors 205, as well as object information, vehicle control outputs, vehicle sensor outputs, and vehicle operator input from fusion and control module 230. ADAS analytics module 340 may further receive data from ADAS-operator interface 232, V2X modules 226, camera module 227, navigation subsystem 228, as well as from external devices 225 and/or ADAS cloud server 234 via extra-vehicle communication system 224.

ADAS analytics module 240 may be configured to identifying actions of the vehicle operator that are inconsistent with automated driving outputs of the fusion and control module 230. The information regarding the inconsistencies may be uploaded to an ADAS cloud server 234 via extra-vehicle communication system 224 for analysis.

Vehicle 201 may include a monitoring module 280 as part of ADAS system 200. However, it will be appreciated that embodiments where the monitoring module is not part of the ADAS system is also within the scope of the disclosure. In such cases, the monitoring module may communicate with the ADAS system via a vehicle network, for example. Monitoring module 280 may be configured for generating and/or updating trust scores of one or more sub-systems and one or more components of the vehicle system 201, and/or analyzing received trust scores from one or more other vehicles within a threshold radius of vehicle system 201. While the present example illustrates generation and update of trust scores, and analysis of received trust scores performed by monitoring module 280. It will be appreciated that, the above-mentioned operations including generation and update of trust scores, and/or analysis of received trust scores may be performed via any controller module within vehicle 201. Trust scores may provide an indication of reliability of data output by one or more components and sub-systems of vehicle 201. Likewise, trust scores received by vehicle 201 from one or more other vehicles near vehicle 201 may provide an indication of reliability (or trustworthiness) of data output by the one or more other vehicles.

Trust scores may be based on functional safety classification of vehicle sub-systems and components according to a functional safety standard, such as ISO-26262. For example, trust scores may assume the enumerated values "QM", "A", "B", "C", or "D" to reflect ASIL-levels as defined in ISO-26262. In that case, trust scores may be established for each vehicle component and sub-system at the time of vehicle development and not changed throughout the vehicle life. Functional safety classification data and/or generated trust scores of vehicle sub-systems and components may be stored within monitoring module 280. Additionally or alternatively, functional safety data and/or generated trust scores may be stored within any storage module within in-vehicle computing system 210. In some examples, functional safety data and/or generated trust scores may be stored in a cloud server and accessed via extra-vehicle communication system 224.

Trust scores for one or more sub-systems and one or more components of vehicle 201 may be generated and updated by a trust score determination module 290 within monitoring module 280. Monitoring module 280 may receive vehicle operation data including sub-system operation information from ADAS sensors 205, vehicle sensors 220, as well as vehicle operator input from fusion and control module 230, and navigation sub-system 228. Monitoring module 280 may associate trust scores with respective vehicle operation data prior to broadcasting. Subsequently, trust scores, along with sub-system operation information (e.g., sub-system operating status, sub-system operating parameter, and sub-system diagnostic data) may be broadcasted to one or more other vehicles via V2X modules 226 and extra-vehicle communication system 224.

By determining and broadcasting trust scores along with sub-system operation information, reliability of the broadcasted data may be determined across different vehicle manufacturers. Details of generating trust scores and updating trust scores within a vehicle system will be further elaborated with respect to FIGS. 4, 6, 7, 8, and 11. Details of broadcasting trust scores will be further elaborated with respect to FIG. 9. The broadcasted data including sub-system operation information and associated trust sores may be utilized by one or more other vehicles communicating with vehicle 201 (through extra-vehicle communication system 224) to determine a level of trustworthiness of sub-system operation information broadcasted by vehicle 201 and subsequently, adjust longitudinal control (e.g., brake and throttle control) and/or lateral control (e.g., steering) of the one or more other vehicles based on the sub-system operation data and associated trust scores.

Likewise, vehicle 201 may receive vehicle operation data and associated trust scores from the one or more other vehicle communicating with vehicle 201. Based on the received vehicle operation data and received trust scores, vehicle control system 216 may adjust longitudinal and/or lateral control of vehicle 201. For example, sub-system operation information and associated trust scores received from the one or more other vehicles communicating with vehicle 201 may be analyzed by trust score analysis module 295, which may then deliver the output of analysis to fusion and control module 230 within vehicle control system 216. Based on the analysis, fusion and control module 230 may perform one or more control actions via one or more vehicle actuators 223 (e.g., braking, throttle, drivetrain, and/or steering actuators) to adjust longitudinal and/or lateral control of vehicle 201.

For example, vehicle 201 may be communicating via DSRC with a leading vehicle traveling ahead of vehicle 201 in the same lane. Vehicle 201 may receive a vehicle speed data from a vehicle speed sensor included in the leading vehicle providing an indication of the leading vehicle speed. Further, in addition to the vehicle speed data, vehicle 201 may receive a trust score for the vehicle speed data indicating a trustworthiness of the vehicle speed data transmitted by the leading vehicle. Trust score analysis module 295 may compare the received trust score of the vehicle speed sensor to a threshold score. The result of the comparison may then be delivered to the fusion and control module 230. Responsive to the trust score of the vehicle speed sensor below a threshold, the fusion and control module 230 may adjust one or more vehicle actuators 223 (e.g., brake, drivetrain, steering, etc.) to adjust longitudinal and/or lateral control of vehicle 201 in order to increase a distance from the leading vehicle and/or change lanes. Details of analysis performed by trust score analysis module 295 and control actions taken by fusion and control module in response to the analysis will be further elaborated with respect to FIGS. 5, 10A and 10B.

Figure 3:
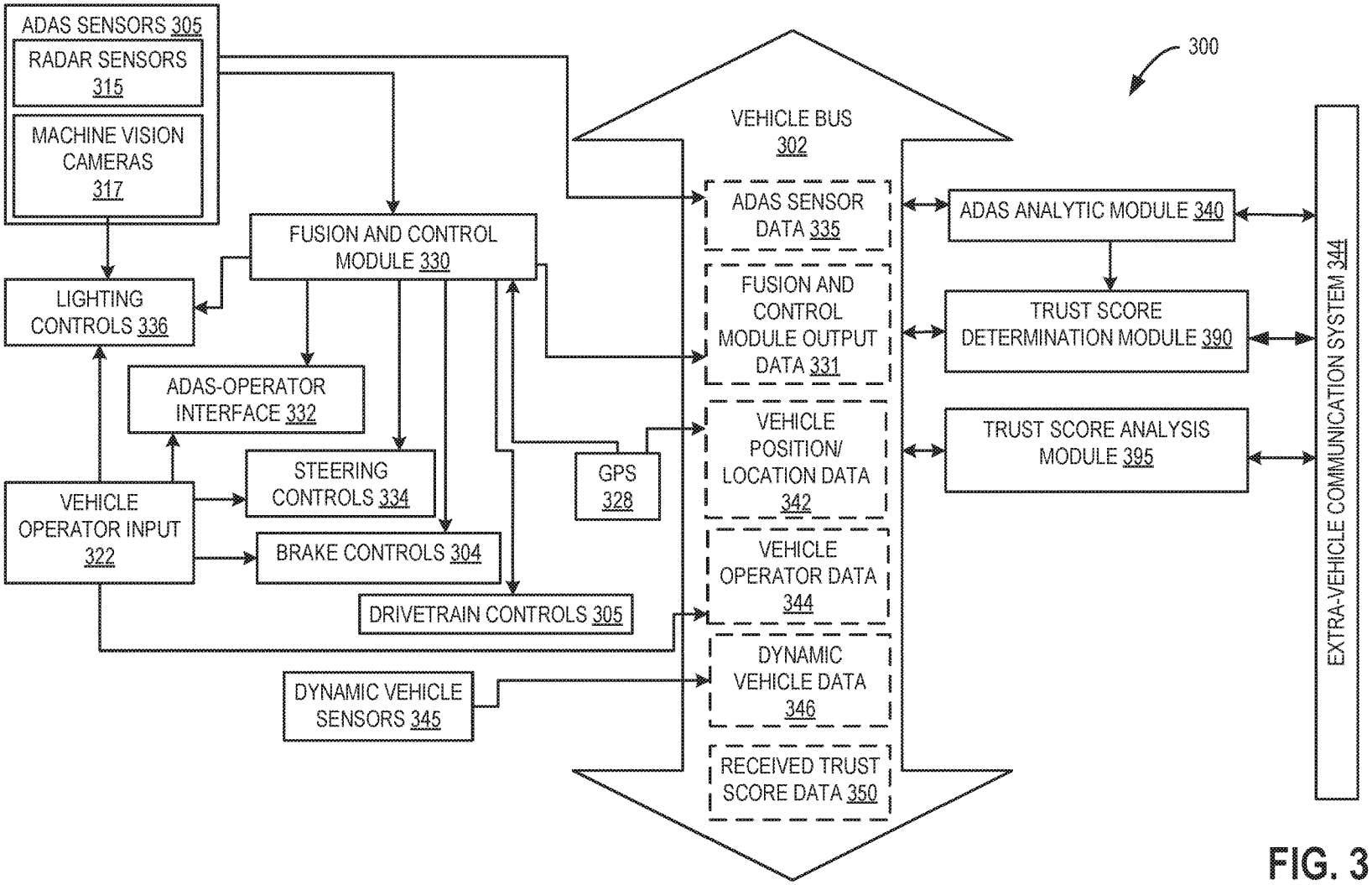
FIG. 3 shows a block diagram of a portion of an example vehicle data network in accordance with one or more embodiments of the present disclosure.

FIG. 3 is a block diagram illustration of a portion of an example vehicle data network 300. Vehicle data network 300 may be an example of intra-vehicle communication system 214. Vehicle data network 300 may comprise vehicle bus 302. For example, vehicle bus 302 may comprise a controller area network (CAN), automotive Ethernet, Flexray, local interconnect network (LIN), or other suitable network and/or protocol. Vehicle bus 302 may mediate communication and data transfer between various systems and subsystems communicatively coupled to vehicle data network 300.

Vehicle bus 302 may be communicatively coupled to fusion and control module 330, ADAS analytic module 340, trust score determination module 390, and trust score analysis module 395. Fusion and control module 330 may be an example of fusion and control module 230, ADAS analytic module 340 may be an example of ADAS analytic module 240, trust score generation module 390 may be an example of trust score generation module 290 and trust score analysis module 395 may be an example of trust score analysis module 295.

Fusion and control module 330 may be communicatively coupled to ADAS sensors 305. ADAS sensors 305 may be an example of ADAS sensors 205. ADAS sensors may include radar sensors 315 and machine vision cameras 317. Radar sensors 315 may be configured to identify and track vehicles, pedestrians, bicyclists and other objects and report those to a fusion and control module 330. Objects identified by the radar sensors 315 may enable driver assistance in avoiding collisions, parking, adaptive cruise control, lane change events, blind-spot detection, etc. Machine vision cameras 317 may capture images from the environment outside of a vehicle. Machine vision cameras 317 may be configured to redundantly identify objects and report those to fusion and control module 330. The machine vision camera may also identify lane markings, traffic signs, and characteristics of the road ahead, (e.g., curvature, grade, condition) and may report those to fusion and control module 330. Further, the machine vision cameras 317 may be configured to identify environmental characteristics, such as ambient light levels, precipitation, etc.

Fusion and control module 330 may combine information received from ADAS sensors 315, as well as data received from GPS 328, and may be configured to determine vehicle control actions in response thereto. GPS 328 may be comprised in a vehicle navigation subsystem, such as navigation subsystem 228. Fusion and control module 330 may indicate information about the vehicle's path and environment to the vehicle operator via ADAS-operator interface 332.

In some scenarios, fusion and control module 330 may generate vehicle control actions based on analysis of received trust score data 350 received from one or more other vehicles communicating with the vehicle, and may output instructions to one or more vehicle actuators (such as vehicle actuators 223) to enact the control actions. As non-limiting examples, fusion and control module 330 may be communicatively coupled to brake controls 304 which may be included in a braking system (e.g., braking system 104 and/or 154), and drivetrain controls 305, which may be included in a drivetrain system (e.g., drivetrain systems 105 and/or 155). Fusion and control module may output instructions to brake controls 304 and/or drive train controls 305 to adjust a longitudinal movement of the vehicle. As another non-limiting example, fusion and control module 330 may output corresponding information to the vehicle operator via ADAS-operator interface 332 concurrently with, or in advance of outputting vehicle control actions. In yet another non-limiting example, fusion and control module 330 may be communicatively coupled to steering controls 334.

As an example, fusion and control module 330 may output instructions to brake controls 304 to increase wheel braking to increase a distance from a leading vehicle in response to determining that at least one safety critical sub-system (e.g., an electronic throttle control sub-system, a braking sub-system, a steering sub-system, etc.) of the leading vehicle has a trust score less than a threshold score. As another example, fusion and control module 330 may output instructions to steering controls 334 to apply torque to the vehicle steering and adjust the trajectory of the host vehicle. For example, fusion and control module 330 may output instructions to steering controls 334 to change lanes from a current lane to an adjacent lane in response to determining that at least one safety critical sub-system of a leading vehicle in the same lane has a trust score less than a threshold score.

Output from radar sensors ADAS sensors 305 may be routed through vehicle bus 302 tagged as ADAS sensor data 335. Output from fusion and control module 330 may be routed through vehicle bus 302 tagged as fusion and control module output data 331. Similarly, data from GPS 328 may be routed through vehicle bus 302 tagged as vehicle position/location data 342, and actions of the vehicle operator, including vehicle operator input 322, may be routed through vehicle bus 302 tagged as vehicle operator data 344. Data from dynamic vehicle sensors 320 may be routed through vehicle bus 302 tagged as dynamic vehicle data 346. Dynamic vehicle sensors 320 may be an example of vehicle sensors 220, and may include sensors configured to output data pertaining to vehicle status, vehicle operation, system operation, engine operation, ambient conditions, diagnostics etc. Data 335, 331, 342, 344, and 346 routed through vehicle bus 302 may be selectively directed to ADAS analytic module 340 for analysis and trust score determination module 390 for associating trust scores to vehicle operation data prior to transmission via extra-vehicle communication system 344. Details of generating and broadcasting trust scores will be further explained with respect to FIG. 4 below and FIGS. 6-9.

Data received from one or more other vehicles including sub-system operation data and associated trust scores of the one or more other vehicles may be analyzed by trust score analysis module 395. Data output from trust score analysis module 395 may be tagged as received trust score data 350 and may be routed through vehicle bus 302. Received trust score data 350 may be selectively routed to fusion and control module 330 for adjusting vehicle operation via the vehicle actuators. Details regarding analysis of received trust score data will be further elaborated with respect to FIGS. 10A and 10B.

Figure 4:
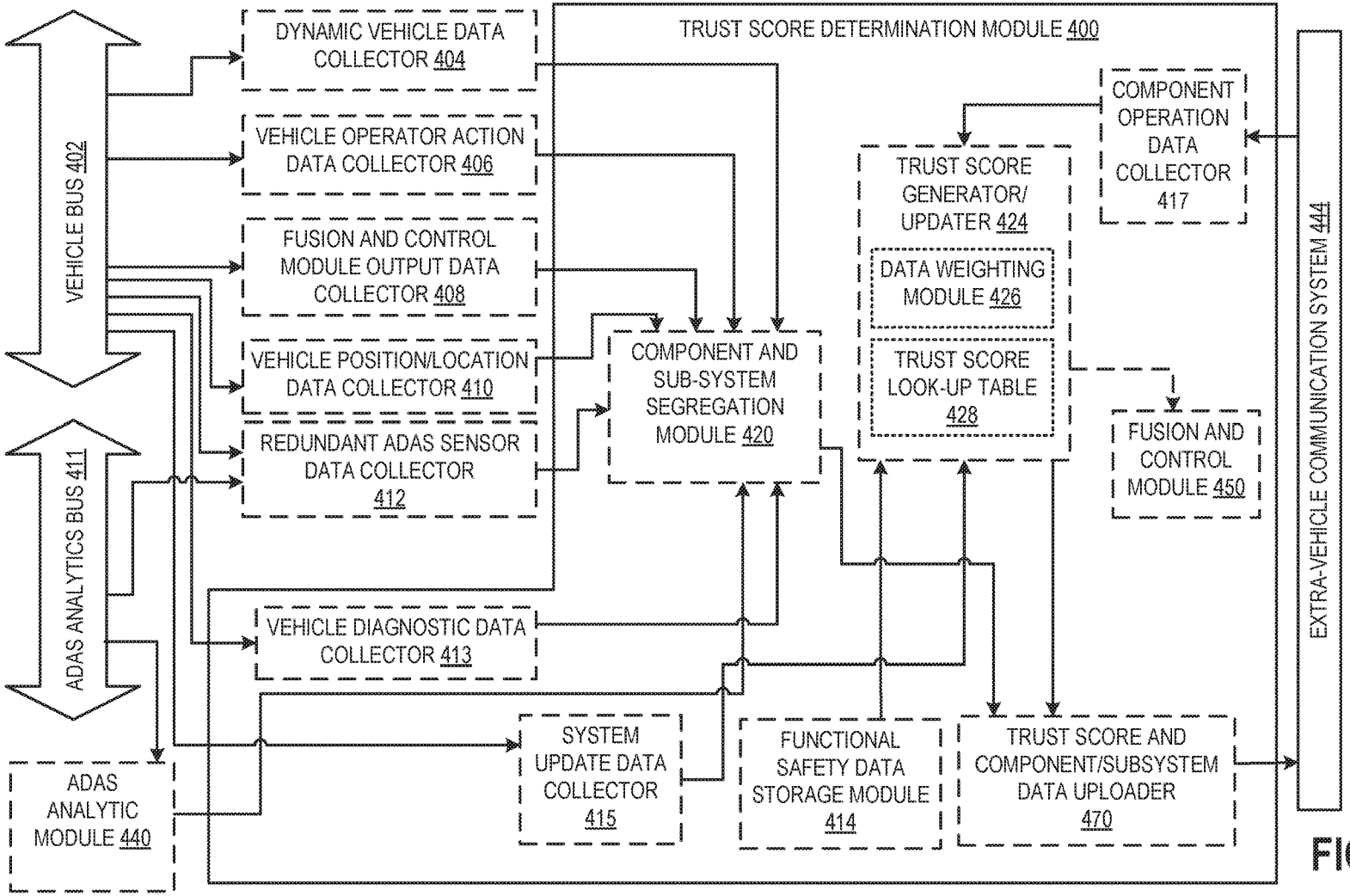
FIG. 4 shows a block diagram of a trust score determination module in accordance with one or more embodiments of the present disclosure.

FIG. 4 shows an example block diagram of a trust score module 400. Trust score determination module 400 may be an example of trust score determination module 390, and may be included within monitoring module 380. Trust score determination module 400 may be configured to store and/or generate trust scores for individual components and sub-systems comprising one or more individual components within a vehicle, such as vehicle 100 and/or vehicle 150. Trust scores may be based on a certified functional safety classification, such as automotive safety integrity level (ASIL), for individual components and sub-systems that is determined during development of the vehicle. In that case, the trust score may be an enumerated variable, assuming the valued "QM", "A", "B", "C", or "D" to reflect the automotive safety integrity levels defined in ISO-26262. The trust score may also be an integer value, e.g., a number between 0 and 100. A trust score may reflect the trustworthiness of information associated with the trust score. A trust score of "QM" may indicate that the associated information should not be used in making control decisions that, if the underlying information is incorrect, could cause a hazard. A trust score of "D" may indicate that the associated information may be used in making control decision that, if the associated information were wrong, could cause a severe hazard. Further, trust scores for each sub-system may be based on a contribution of each individual component within a sub-system. Trust scores may provide an indication of an integrity level of function each component or sub-system. Trust scores may be periodically updated during the course of vehicle operation or remain unchanged over the life of the vehicle. When trust scores are updated, updating of the trust scores may be based on a collective functional data based on operation of similar systems in a plurality of vehicle systems, for example. Individual components may be any one of one or more sensors coupled to an engine system, one or more sensors coupled to a vehicle system, one or more actuators (e.g., motors) coupled to the engine system and the vehicle system, and one or more processors included within an in-vehicle computing system. Individual components may be components other than sensors or actuators or processors, such as one or more valves, that may be utilized within a sub-system that enables the sub-system to perform a desired function. Individual components may be one or more set of instructions stored in a memory of the processors for adjusting an operation of one or more actuators based on indication received from one or more sensors.

Each sub-system may be configured to perform one or more vehicular functions and/or sense vehicular operating parameters and may comprise one or more individual components. For example, each sub-system may comprise one or more of one or more sensors, one or more actuators, and one or more processors that receive information from the one or more sensors and adjust operation of one or more actuators according to instructions stored in the memory of the processor to perform a desired vehicular function. Each sub-system may also include intra and inter vehicular communication systems, such as CAN bus, etc. that are utilized to transmit and receive information between individual components of a sub-system.

Examples of sub-systems may include electronic throttle control systems, braking systems, drivetrain systems, power steering systems, active suspension control systems, chassis domain control systems, tire pressure monitoring systems, seat belt pretensioner systems, emergency braking systems, electronic stability control systems, navigation systems, ADAS systems, climate control systems, battery systems, fuel injection systems, fuel vapor purging systems, exhaust gas recirculation systems, boosted engine systems, inter-vehicle communication system, in-vehicle computing system, etc. Examples of sub-systems may also include sensor sub-systems including redundant sensors.

Trust score module 400 may be further configured to update trust scores for the individual components and sub-systems. Updated trust scores may be broadcasted via V2X communication systems, such as extra vehicle communication system 444. In one example, extra vehicle communication system 444 may include an OEM-installed or after-market device that enables a vehicle to receive and/or transmit wireless signals corresponding to voice, text, and/or other data. Thus, the device may send and/or receive wireless signals (e.g., electromagnetic waves) such as Wifi, Bluetooth, radio, cellular, etc. In one example, the device may be configured as a transceiver since it may be capable of both sending and receiving wireless signals. Wireless signals comprising trust score data produced by the device of one vehicle may be sent to and received by one or more other vehicle via one or more transceivers installed in the one or more other vehicles. Additionally or alternatively, the wireless signals comprising trust score data may be sent to and received by a remote server, which may then transmit the wireless signal to one or more other vehicles that are in wireless communication with the remote server. Thus, each of the vehicles may be in wireless communication with one another for sending and/or receiving information there-between via the device. Further, each of the vehicles may be in wireless communication with one or more remote servers for sending and/or receiving information there-between.

Trust score module 400 may receive data from a dynamic vehicle data collector 404. Dynamic vehicle data collector 404 may be configured to receive data from dynamic vehicle sensors (e.g., dynamic vehicle sensors 345) via vehicle bus 402. Dynamic vehicle sensors 345 may include one or more sensors within a vehicle, such as engine parameter sensors, battery parameter sensors, vehicle parameter sensors, fuel system parameter sensors, ambient condition sensors, cabin climate sensors, etc. Further, vehicle sensors 345 may include a vehicle speed sensor, wheel speed sensors, steering angle sensor, yaw rate sensor, and acceleration sensor within the vehicle. Dynamic vehicle sensor data may comprise data pertaining to vehicle subsystem status, such as whether a subsystem (e.g., cruise control, anti-lock brakes, windshield wipers, electronic throttle control, electronic braking control, engine braking system etc.) is actuated (or active), and if so, the current operating parameters of the system. Dynamic vehicle sensor data may further comprise data pertaining to vehicle operating parameters based on indication from the dynamic vehicle sensors. Data pertaining to vehicle operating parameters may include vehicle speed, current acceleration, expected acceleration, trajectory, yaw rate, braking, battery state of charge, current location, future location etc. Dynamic vehicle sensor data may comprise data pertaining to engine operating parameters, such as engine speed, engine load, commanded air/fuel ratio, manifold adjusted pressure, exhaust gas recirculation rate, boost pressure etc. Dynamic vehicle sensor data may further comprise data pertaining to ambient conditions, such as temperature, barometric pressure, etc. Dynamic vehicle sensor data may comprise additional data obtained from vehicle sensors, systems, actuators, etc. as they pertain to ADAS analytics.

Trust score determination module 400 may receive data from vehicle operator action data collector 406. Vehicle operator action data collector 406 may be configured to receive data pertaining to vehicle operator input (e.g., vehicle operator input 322) via vehicle bus 402. For example, vehicle operator input data may comprise steering torque, steering angle, brake pedal position, accelerator position, gear position, etc.

Trust score determination module 400 may further receive data from fusion and control module data collector 408, may be configured to receive data from a fusion and control module (e.g., fusion and control modules 230 and/or 330) via vehicle bus 402. Data received from the fusion and control module may pertain to actions taken by the fusion and control module responsive to data received from vehicle systems and sensors. For example, corrective actions taken by a fusion and control module, such as vehicle-operator warnings, automatic braking, automatic steering control, evasive actions, etc. Fusion and control module output data collector 408 may also receive and collect data pertaining to driver alertness, collision events, near-collision events, lane deportation, automatic lighting adjustments, and other data output by the fusion and control module of the host vehicle.

Trust score determination module 400 may further receive data from vehicle position/location data collector 410, which may be configured to receive data from a vehicle GPS and/or other navigation system (e.g., GPS 328, navigation subsystem 228) via vehicle bus 402. Vehicle position/location data collector 410 may receive and collect data including, but not limited to, GPS derived latitude & longitude, maps of the current vehicle location and surrounding areas, speed limits, road class, weather conditions, and/or other information retrievable through a navigation system.

Trust score determination module 400 may receive data from redundant ADAS sensor data collector 412, which may be configured to receive data from ADAS sensors (e.g., ADAS sensors 305) via ADAS analytics bus 411. Redundant ADAS sensor data collector 412 may receive and collect data output by ADAS sensors, including properties of nearby objects detected by ADAS sensors. In some examples, redundant ADAS sensor data collector 412 may additionally or alternatively receive and collect raw data from ADAS sensors. In examples where the host vehicle comprises multiple radar sensors, machine vision cameras, etc., a primary sensor for each sensor class (e.g., a machine vision camera trained on the environment in front of the host vehicle) may be designated. Output of other sensors within a sensor class may be ignored or discarded, and/or may be selectively collected by redundant ADAS sensor data collector 412 responsive to pre-determined conditions being met.

Trust score determination module 400 may include a vehicle diagnostic data collector 413, which may be configured to receive diagnostic data of individual components and sub-systems via vehicle bus 402. For example, diagnostic data may provide an indication of degradation or malfunction of one or more individual components and/or sub-systems determined during diagnostic tests performed by a vehicle controller on individual components or sub-systems. As one non-limiting example, the vehicle controller may perform a leak test on a fuel system coupled to the vehicle when entry conditions for the leak test are met. If the results of the leak test indicate degradation of a component of the fuel system, such as a purge valve, diagnostic data may include indication of degradation of the purge valve. As another non-limiting example, the vehicle controller may perform diagnostics on fuel injectors coupled to the engine to determine if one or more fuel injectors are clogged and provide indication regarding degradation of fuel injectors to the vehicle diagnostic data collector 413 via vehicle bus 402. Similarly, vehicle diagnostic data collector 413 may receive indication of degradation of one or more sensors, one or more actuators, and other components within each sub-system of the vehicle. In one example, responsive to an indication that a component or a sub-system is degraded, data regarding degradation or mal-function of the component or the sub-system may be broadcasted via extra-vehicle communication system 444 along with trust scores for the degradation data. In this way, trust scores provide an indication as to whether the degradation data can be trusted.

Vehicle component and sub-system diagnostic data collector 413 may also receive indications regarding a remaining operation life of one or more individual components and/or sub-systems based on expected degradation of one or more individual components and/or sub-systems based on usage over time. For example, a remaining life of a brake pad may be determined based on a duration of operation of the brake pad. In some examples, the remaining operation life of one or more individual components and/or sub-systems may be broadcasted along with trust scores for the remaining operation life indication.

Trust score determination module 400 may include a component and sub-system update data collector 415. Component and sub-system update data collector 715 may be configured to receive information regarding measures taken in response to indication of degradation of an individual component or sub-system. The measures taken in response to indication of degradation may include operations performed based on instructions stored in the vehicle controller to reduce degradation of the individual component or sub-system. For example, upon determining that a fuel injector in clogged, the vehicle controller may initiate operations to un-clog the fuel injector. Thus, component and sub-system update data collector 415 may receive information regarding the operations to un-clog the fuel injector.

The measures may further include operations performed by a vehicle operator in response to indication of degradation provided by the vehicle controller. The operations performed by the vehicle operator may include replacement operations. For example, when clogging of a fuel injector is determined, during certain conditions, it may be desirable to replace the fuel injector. Thus, a vehicle operator may replace the clogged fuel injector. Consequently, component and sub-system update data collector 415 may receive information that the fuel injector has been replaced. As another example, during routine diagnostics, the vehicle controller may indicate degradation of an exhaust gas recirculation system of the vehicle to the controller, in response to which, the vehicle operator may repair or replace one or more components of the exhaust gas recirculation system. Further, component and sub-system update data collector 415 may receive data regarding routine maintenance operations performed by a vehicle operator. For example, in response to an oil change, component and sub-system update data collector 415 may receive indication regarding the oil change. In some examples, component or sub-system trust score may be updated based on the update data of the respective component or sub-system updates.

Trust score module 400 may include a functional safety data storage module 414. Functional safety data storage module 414 may include functional safety classification data for each individual component or sub-system based on implementation of protocols during product development by a manufacturer of the individual component or sub-system according to a functional safety standard, such as ISO 26262. The functional safety classification may be QM or one of the four levels of Automotive Safety Integrity Level (ASIL), such as ASIL A, ASIL B, ASIL C, or ASIL D, with ASIL D being the highest standard for safety classification. For example, an individual component may be developed to meet ASIL D. Thus, function safety storage module 414 may include indication that the individual component meets ASIL D standards.

Functional safety data storage module 414 may also include indication if an individual component or sub-system is not implemented according to function safety standards. Further, functional safety data storage module 414 may include indication if an individual component or a sub-system meets functional safety standards through a "proven in use" protocol. For example, some vehicular systems may include individual components and/or sub-systems that have not been tested by the manufacturer according to functional safety standards of QM or ASIL A, B, C, or D but have been used in earlier versions of the vehicle and deployed in a desired number of vehicles with reduced incidents. Such individual components and sub-systems may not be classified as QM or ASIL A, B, C, or D and may be classified as "proven in use".

Trust score determination module 400 may include a component and sub-system segregation module 420. The component and sub-system segregation module 420 may be configured to receive data collected by dynamic vehicle data collector 404, vehicle operator action data collector 406, fusion and control module output data collector 408, vehicle location/position data collector 410 and redundant ADAS sensor data collector 412. Component and sub-system segregation module may further receive data from vehicle diagnostic data collector 413, vehicle update data collector 415 and an ADAS analytic module (not shown), such as ADAS analytic module 340 that may identify actions of the vehicle operator that are inconsistent with automated driving outputs of the fusion and control module.

Component and sub-system segregation module 420 may be configured to segregate the received data into a first group comprising each of the individual components of the vehicle system and a group 2 comprising a plurality of sub-systems, comprising one or more individual components integrated to perform one or more functions. Thus, each of the plurality of sub-systems may include one or more individual components and instructions, such as instructions stored in a memory of a controller that integrates one or more individual components to perform a desired sub-system function.

Component and sub-system segregation module 420 may assign an operating status to one or more individual components and/or one or more sub-systems based on the data received from dynamic vehicle data collector 404, vehicle operator action data collector 406, fusion and control module output data collector 408, vehicle location/position data collector 410, redundant ADAS sensor data collector 412, vehicle diagnostic data collector 413, vehicle update data collector 415 and the ADAS analytic module. Further, in some examples, additionally, component and sub-system segregation module 420 may assign at least one of a diagnostic status, an update status, and a functional status to the one or more individual components and/or one or more sub-systems based on the data received from data collectors 404, 406, 408, 410, 412, 413, 415 and the ADAS analytic module.

Operating status may include an indication of status of the individual component or sub-system (e.g., actuated, active, etc.) and an operating parameter of the individual component or sub-system (e.g., a valve opening amount, acceleration, engine speed, vehicle speed, yaw rate, etc.). Diagnostic status may include an indication of degradation or malfunction of the individual component or sub-system (e.g., mal-function, a degree of degradation). Update status may include an indication if an individual component or one or more components of a sub-system are repaired or replaced. A functional status may include an indication pertaining to whether an individual component or a sub-system is operating within a threshold expected range. That is, functional status may include an indication as to whether a difference between an expected output and a delivered output of an individual component or a sub-system is within a threshold difference.

Outputs of the component and sub-system segregation module 420 including the operating status of one or more individual components and/or sub-systems of the vehicle may be delivered to a trust score and component/subsystem data uploader 470. In some examples, additionally, diagnostic status, update status, and functional status of one or more individual components and/or sub-systems of the vehicle may be delivered to trust score and component/subsystem data uploader 470. Trust score and component/subsystem data uploader 470 may also receive trust scores for the corresponding individual components and/or sub-systems from a trust score generator/updater module 424.

Trust score updater module 424 may be configured to generate and update trust scores for each individual component and each sub-system of a vehicle system based on inputs from function safety data storage module 414, system update data collector 415, and a component operation data collector 417. Component operation data collector 417 may receive, via extra-vehicle communication system 444, data regarding usage of similar components and/or sub-systems from one or more other vehicle systems based on "proven in use" protocol. The usage may be based on a number of hours of operation of the sub-system without failure or degradation. For example, a number of vehicles may each include a sub-system "A" developed by a OEM. Thus, a component operation data for sub-system "A" may include a cumulative number of hours determined as a sum of number of hours of operation of sub-system "A" in the number of vehicles. The sub-system "A" may be determined to be "proven in use" if the cumulative number of hours exceeds a threshold number (e.g., 10 billion hours). The threshold may vary depend on a safety-critical critical aspect of the sub-system. In one example, a cloud system may be configured to receive a number of hours of operation of sub-systems and/or components from each vehicle communicating with the cloud. The cloud system may be further configured to determine the cumulative number of hours of sub-system and/or components based on the number of hours of operation of similar sub-system and/or components in each vehicle. The cumulative number of hours may be received by the data collector 417 from the cloud via extra-vehicle communication system 444.

Trust score updater module 424 may include a data weighting module 426 and trust score look-up table 428. Trust score update module 724 may be configured to assign weightage to one or more components of a sub-system based on functional safety data for each of the components of the sub-system and/or contribution of each individual component towards a function of the sub-system. Details of generating and updating trust scores will be elaborated with respect to FIGS. 6-11.

Trust scores may be stored in the trust score look-up table 428 within the trust score updater 424. Generated and/or updated trust scores output from the trust score updater 424 may be delivered to a trust score and component/sub-system data uploader 470 for associating trust scores to one or more individual components and/or sub-systems and broadcasting component and/or sub-system operation data along with trust scores for the respective broadcasted component/sub-system operation data via extra vehicle communication systems 444. Said another way, the trust score uploader 470 may receive component/sub-system operation data from the component and sub-system segregation module, assign relevant trust scores to the component/sub-system operation data and transmit the component and/or sub-system operation data along with the assigned trust scores.

In some examples, additionally, output from the trust score updater comprising trust scores of individual components and sub-systems may be delivered to fusion and control module 430, which may be an example of fusion and control module 330, for adjusting one or more vehicle operations. For example, for sensor sub-system comprising at least two redundant sensors, if a first redundant sensor has a trust score less than a second redundant sensor, fusion and control module may selectively utilize output from the second redundant sensor with a greater trust score to determine a control action.

In some examples, trust score determination module 400 may be further configured to determine one or more additional factors that contribute to a function of a sub-system. Additional factors for each sub-system of a vehicle may be variable. For example, additional factor for one or more sub-systems of the vehicle may be based on one or more sub-systems or components of other vehicle systems with which the vehicle is communicating via extra vehicle communication systems. As an example, during a first condition, a first trailing vehicle may be participating in a platooning operation where a vehicle speed of the first vehicle is adjusted based on an accelerator pedal input and brake pedal input of a second leading vehicle. Thus, an electronic throttle control system of the first trailing vehicle system may include the electronic throttle system of the second leading vehicle as an additional factor; and a braking system of the trailing vehicle may include the braking system of the leading vehicle as an additional factors. During a second condition, the first trailing vehicle may not be participating in the platooning operation. Thus, during the second condition, the electronic throttle control system of the first trailing vehicle may not include the electronic throttle control system of the second leading vehicle as additional factor; and the braking system of the first trailing vehicle may not include the braking system of the second leading vehicle as additional factor.

In such examples, trust score determination module 400 may be further configured to determine a contribution of each additional factor towards function of the sub-system. The contribution of additional factors may be based on driver reliance on additional factor, for example. Additional factors may be utilized during trust score update for a sub-system. Therefore, each additional factor may be assigned a trust score determined based on functional safety classification and/or proven usage of the additional factor, and the corresponding sub-system trust score may be updated accordingly. For example, when additional factor for the electronic throttle control system of the first trailing vehicle is the electronic throttle control system of the second leading vehicle, a trust score of the additional factor may be based on a functional safety classification of the electronic throttle control system of the second leading vehicle. Additionally or alternatively, the trust score of the additional factor may be based a current trust score of the electronic throttle control system broadcasted by the second leading vehicle.

Figure 5:
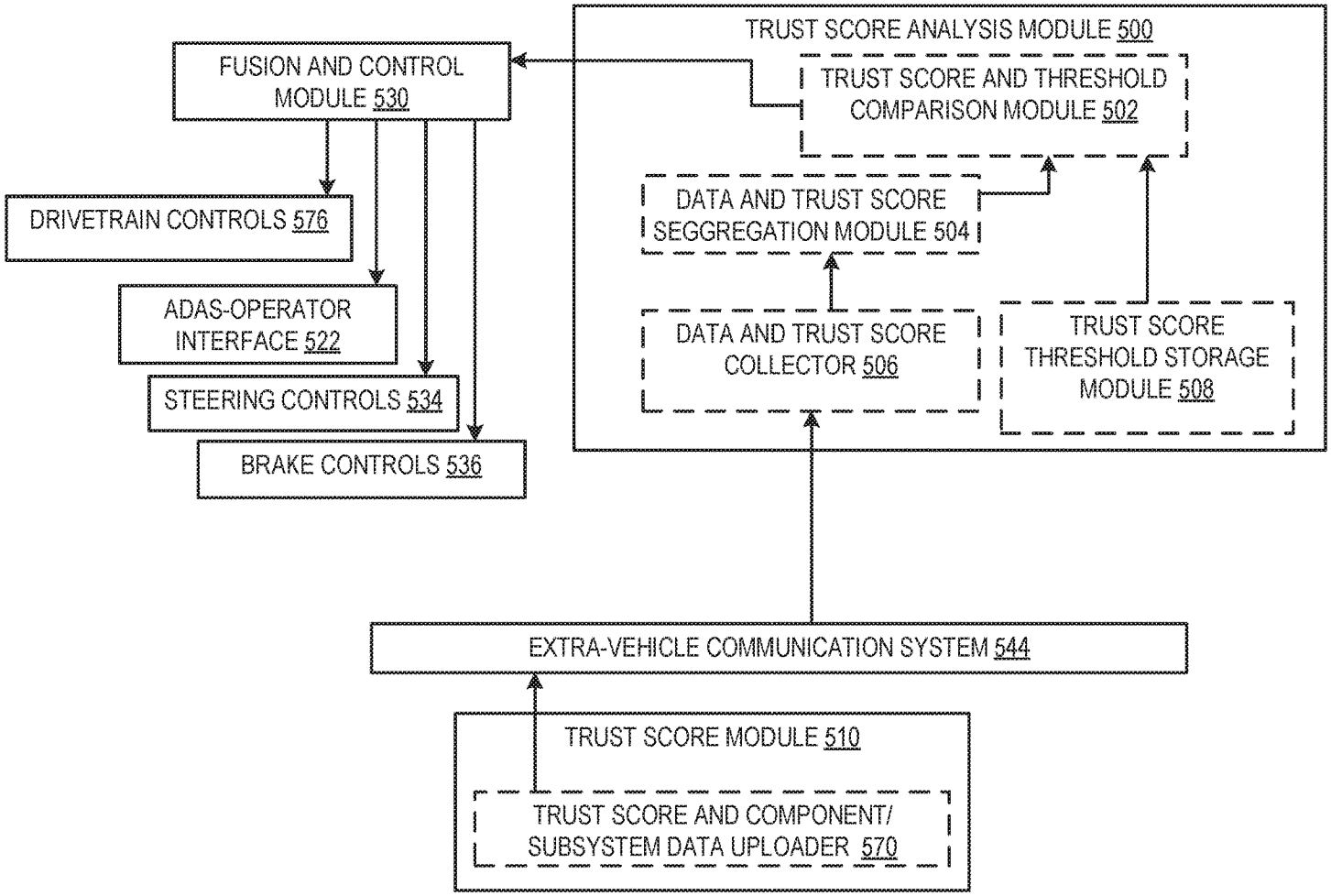
FIG. 5 shows a block diagram of trust score analytic module in accordance with one or more embodiments of the present disclosure.

FIG. 5 shows an example block diagram of a trust score analysis module 500. Trust score analysis module 500 may be an example of trust score analysis module 395. Trust score analysis module 500 may be configured to receive sub-system information (such as sub-system operating status, sub-system operating parameter, and sub-system diagnostic data) and associated trust scores from one or more other vehicles within a threshold distance of a vehicle via extra vehicle communication system 544. Extra vehicle communication system 544 may be an example of extra vehicle communication system 444.

Trust score analysis module 500 may be configured to segregate sub-system and associated trust scores from the one or more vehicles, compare trust scores to respective thresholds, and provide output of the comparison to a fusion and control module 530, which may be an example of fusion and control module 330. Accordingly, trust score analysis module 500 may include a data and trust score collector 506, to receive and collect vehicle operation data including sub-system operation data for each sub-system within a vehicle, including a sub-system operating status, a sub-system operating parameter, and a sub-system trust score, from one or more vehicles within a threshold radius of the vehicle system. In some examples, in addition to sub-system operation data and data regarding additional factors, component operation data, including a component operating status, a component operating parameter, and a component trust score may also be received and collected by the data and trust score collector 506.

Trust score analysis module 500 may include data and trust score segregation module 504, which may be configured to segregate vehicle operation data received from data and trust score collector 506 from different vehicles.

Trust score analysis module 500 may further include a trust score threshold storage module 508 for storing a plurality of thresholds that may be utilized for trust score analysis. For example, based on functional safety classification, a component or sub-system threshold may vary. As an example, a component with a lower functional safety classification, such as ASIL A, may have a lower threshold for comparison than a component or a sub-system with a higher functional safety classification, such as ASIL D. In some examples, alternatively, trust score thresholds may be downloaded from a cloud computing system via extra-vehicle communication system 544 and used for trust score analysis.

Trust score analysis module 500 may further include a trust score and threshold comparison module 502 for analyzing the received trust scores. Thus, trust score and threshold comparison module 502 may receive inputs from trust score threshold storage module 508, and data and trust score segregation module 504. Trust score and threshold comparison module 502 may be configured to adjust thresholds based on vehicle operation data received from one or more vehicles. In some examples, the thresholds may be further adjusted based on road conditions and environmental factors (weather) etc., determined by the receiving vehicle based on vehicle and position data, such as vehicle and position data 422, determined by a navigation system, such as GPS 420. For example, if icy road conditions are determined, the thresholds may be increased.

Trust score and threshold comparison module 502, may output parsed received trust score data to fusion and control module 530. Based on the data received from the trust score and threshold comparison module 502, fusion and control module 530, may determine a vehicle response. As an example, fusion and control module 530 may generate vehicle control actions, and may output instructions to one or more vehicle actuators to enact the control actions based on received trust scores. One or more vehicle actuators may be examples of vehicle actuators 223. As a non-limiting example, fusion and control module 530 may be communicatively coupled to drivetrain controls 576, which may include electronic throttle controls. As further non-limiting examples, fusion and control module 530 may be communicatively coupled to brake controls 536, and steering controls 534, which may be examples of brake controls 304, and steering controls 334, respectively. In another non-limiting example, fusion and control module 530 may output corresponding information to the vehicle operator via an ADAS-operator interface, such as ADAS operator interface 522, which may be an example of ADAS operator interface 332, concurrently with, or in advance of outputting vehicle control actions.

As an example, fusion and control module 530 may output instructions to brake controls 536 and/or steering controls 534 to decrease vehicle speed and/or change lanes when a trust score for a braking system of a leading vehicle is determined to be below a threshold, in order to increase distance from the leading vehicle and/or stop following the leading vehicle.

Vehicle sensors, like other sensing systems, are subjected to noise. A sensor reading is never perfect, but typically subject to normal distribution around a mean value with a given standard deviation. The ability to trust a sensor is affected by how far the reported sensor value deviates from the true value. In case of an automotive distance sensor, the sensor may e.g., report the distance to a preceding vehicle as 30.00 m, when in fact the true distance is 30.14 m. The trust score discussed in the present disclosure does not necessarily reflect normal sensor accuracy variation. It rather reflects the likelihood of an abnormal sensor output that is the result of a sensor defect. For example, an electronic memory cell may randomly change its value. Instead of reporting "30.14" the sensor may, caused by a bit-flip, report 9.66 m. The trust score reflects the likelihood of such a false output, which is affected by the subsystems ability to recognize and/or correct defect, such as a bit-flip. A subsystem may, e.g., utilize memory with built-in error correction mechanisms, which improves the reliability of electronic memory. The subsystem may also utilize software checksums to detect such single point failures. The trust score may also reflect engineering practices that have been followed in the design and testing of the subsystem. The trust score may be associated with a mean time between failure (MTBF): The higher the MTBF, the higher the trust score.

Figure 6:
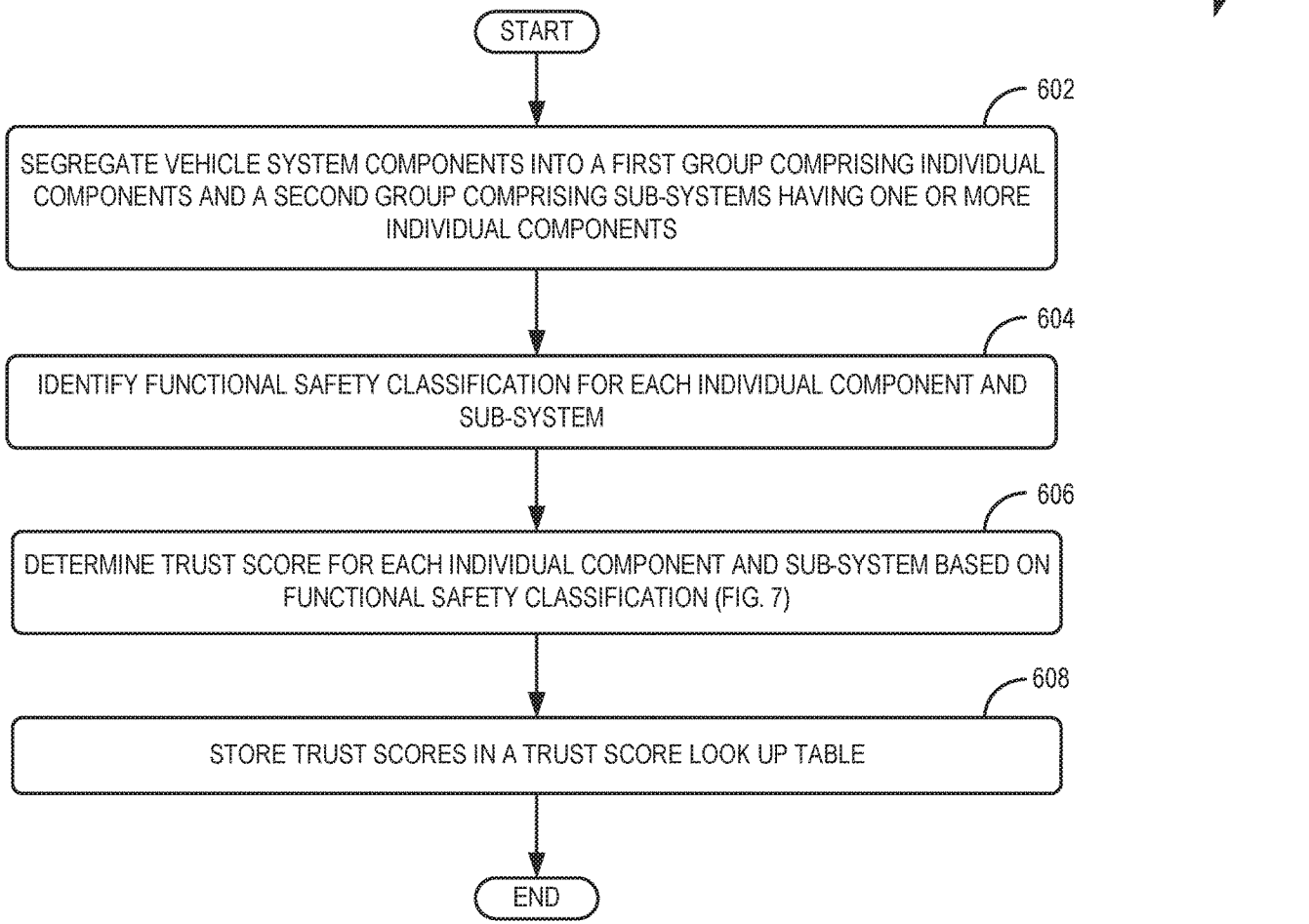
FIG. 6 is a flow chart of an example method for generating and storing trust scores in accordance with one or more embodiments of the present disclosure.

FIG. 6 is a flow chart of an example method 600 for generating trust scores. Specifically, method 600 may be implemented by a trust score determination module, such as trust score determination module 400 at FIG. 4. Method 600 may be performed during a vehicle development process, prior to sale of the vehicle. For example, method 600 may be a first phase of trust score determination, which is trust score generation. Therein, a trust score look up table for a new vehicle, such as a new type (make or model) or new family of vehicles may be developed. Therein, before sale of the vehicle to a consumer, trust scores for plurality of components and plurality of sub-systems of the vehicle system may be stored in the trust score look up table. Method 600 will be described with reference to FIG. 4 and trust score determination module 400, but it should be understood that similar methods may be implemented by other systems without departing from the scope of this disclosure.

Method 600 begins at 602. At 602, method 600 includes segregating vehicle system components into a first group comprising one or more individual components and a second group comprising sub-systems including one or more individual components. Individual components may be electronic and/or mechanical components of a vehicle system, such as one or more sensors included within the vehicle system, one or more actuators included within the vehicle system, and one or more processors included within the vehicle system, and other components, such as one or more valves included within the vehicle system. Sub-systems may include one or more individual components that may be integrated to perform a function. Examples of sub-systems may include electronic throttle control systems, braking systems, drivetrain systems, power steering systems, active suspension control systems, transmission systems, chassis domain control systems, tire pressure monitoring systems, seat belt pretensioner systems, emergency braking systems, electronic stability control systems, navigation systems, ADAS systems, climate control systems, battery systems, fuel injection systems, fuel vapor purging systems, exhaust gas recirculation systems, boosted engine systems, etc.

Upon segregating vehicle system components into individual components and sub-systems, method 600 proceeds to 604. At 604, method 600 includes identifying a functional safety classification for each individual component and sub-system. Functional safety classification for each individual component and sub-system may be provided by a component or sub-system manufacturer and stored in functional safety data storage module, such as functional safety data storage module 414, within the trust score determination module. Functional safety indication may be a functional safety classification of a component or a sub-system. Functional safety classification provides an indication that the component or the sub-system was developed according to a function safety standard, such as ISO 26262. For example, functional safety classifications may include as QM or one of automotive safety integrity levels (ASIL) A, B, C, or D.

Next, method 600 proceeds to 606. At 606, method 600 includes determining trust scores for each individual component and sub-system of the vehicle system based on the identified functional safety classification. Trust scores of each individual component may be based on functional safety classification of the individual component. For example, an individual component with highest function safety classification may be given a higher trust score than an individual component with a lower functional safety classification. For a sub-system comprising one or more individual components, in one example, a sub-system trust score may be based on an average of trust scores of each of the individual components. In another example, the sub-system trust score may be based on weighted average of trust scores of each individual components. The term "weighted average" here considers the role of individual components in a subsystem in determining a subsystem trust score. That is, weightage may be based on contribution of each individual component comprising the first sub-system towards achieving the desired function of the sub-system. For example, a subsystem comprising two redundant sensors, each of which has a trust score of "ASIL B", and which operate independently in parallel and a failure of either of which, but not both, does not cause an overall subsystem failure may have an overall trust score of "ASIL D" (B+B=D). Details regarding determining trust scores will be further elaborated with respect to FIGS. 10A and 10B.

Upon determining the trust scores, method 600 proceeds to 608. At 608, method 600 includes storing the trust scores for each individual component and each sub-system of the vehicle system in the trust score look-up table within the trust score determination module.

Figure 7:
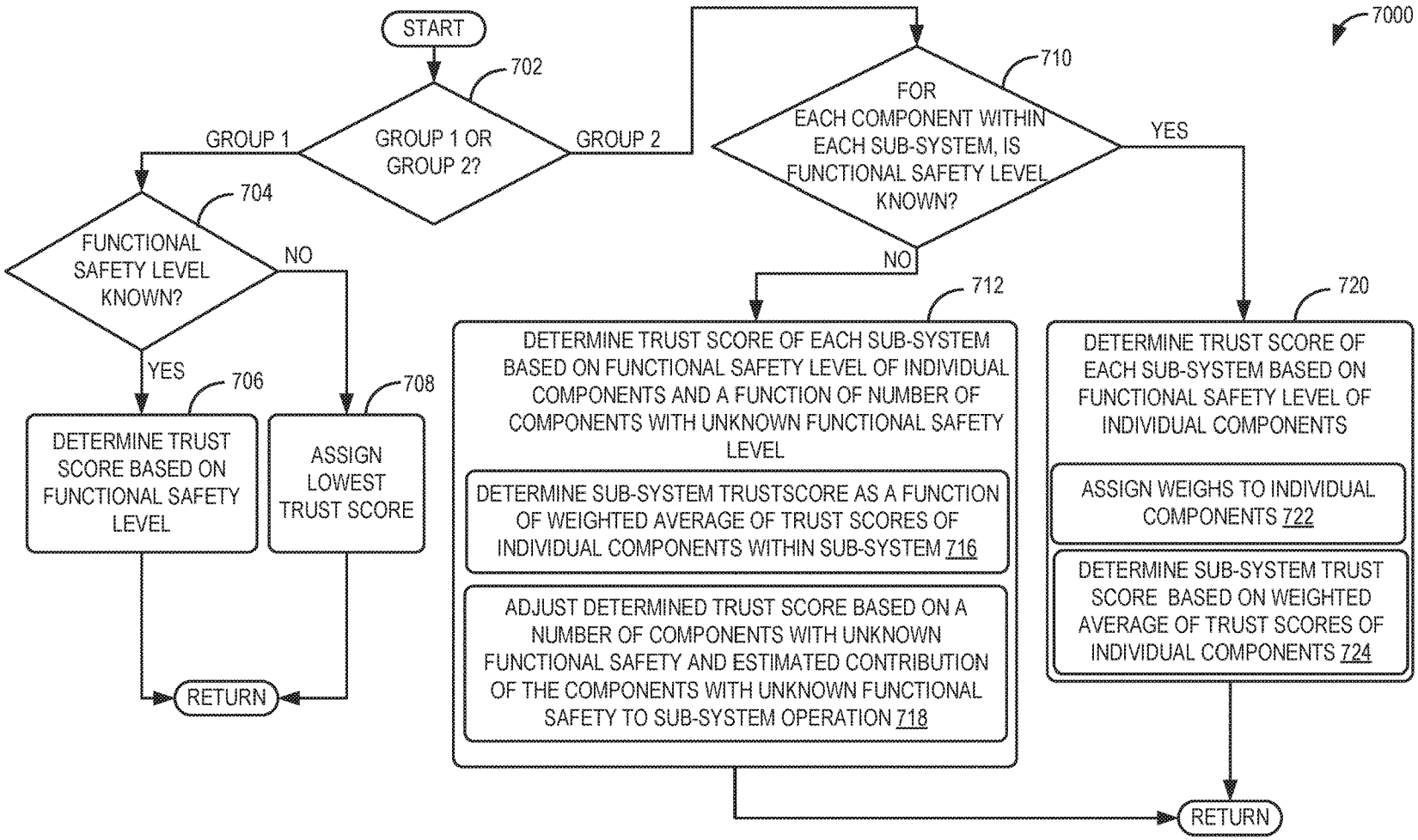
FIG. 7 is a flow chart of an example method for generating trust scores based on functional safety classification data to be performed in coordination with the example method of FIG. 6 in accordance with one or more embodiments of the present disclosure.

FIG. 7 is a flow chart of an example method 700 for generating trust scores that may be performed in coordination with method 600 discussed at FIG. 6 Method 700 may be implemented by trust score determination module, such as trust score determination module 400 at FIG. 4. Similar to method 600, method 700 may be performed during the vehicle development process, prior to sale of the vehicle. Thus, method 700 may be a part of the first phase of trust score generation. Method 700 will be described with reference to FIG. 4 and trust score determination module 400, but it should be understood that similar methods may be implemented by other systems without departing from the scope of this disclosure.

Method 700 begins at 702. At 702, method 700 includes determining if each of a plurality of vehicle system components belongs to group 1 comprising individual components or group 2 comprising sub-system including one or more individual components. If it is determined that a vehicle system component belongs to group 1, method 700 proceeds to 704. At 704, method 700 includes determining if the vehicle system component is developed according to a functional safety standard, such as ISO 26262. If the answer at 704 is YES, method 704 proceeds to 706 to determine a trust score for the vehicle system component based on its functional safety classification. For example, as a functional safety classification level increases, the trust score may increase. For example, a first vehicle system component with higher functional safety classification, such as ASIL D, may be assigned a higher trust score than a second vehicle system component with a lower functional safety classification, such as ASIL C. In one example, the trust score for an individual component (e.g., a sensor or an actuator) may be an enumerated variable, assuming the value "QM", "A", "B", "C", or "D" to reflect the automotive safety integrity level of the individual component as defined in ISO-26262. As discussed herein, the trust score may also be an integer value, e.g., a number between 0 and 100, based on the functional safety classification of the individual component. Higher trust scores may assigned to components that have been certified according to higher safety integrity levels indicating that the information provided by the component with the higher safety integrity level is more trustworthy than the information provided by a component with a lower safety integrity level.

If the answer at 704 is NO, that is, if functional safety classification of the vehicle system component is not known, method 700 proceeds to 708. At 708, method 700 includes assigning a lowest trust score. The lowest trust score may be less than the trust score of a vehicle system component with the lowest functional safety classification, such as QM.

In some examples, additionally, at 708, method 700 may include determining if the vehicle system component is proven in use. For example, it may be determined if the vehicle system component has proven functionality in use based on utilization of the vehicle system component in older systems. For example, if a vehicle system component is known to have been operated without degradation or mal-function that resulted in hazardous events for a cumulative number of hours (based on operation information from fleet of vehicles, each including the vehicle system component), greater than a threshold, the vehicle system component may be determined to be proven in use. Accordingly, a higher trust score that is greater than the lowest trust score may be provided to the vehicle system component that is proven in use. The higher trust score may be based on the cumulative number of hours, for example. As the cumulative number of hours increase, the trust score may be greater.

Returning to 702, if it is determined that a vehicle system component belongs to group 2, method proceeds to 710. As discussed above, group 2 components may be sub-systems comprising one or more individual components. At 710, method 700 includes determining if functional safety classification is known for each individual component of the sub-system. If the answer at 710 is YES, method 700 proceeds to 720. At 720, method 700 includes determining trust scores based on functional safety classification of each individual components of the sub-system. In one example, determining trust scores based on functional safety classification of each individual component of the sub-system may include, determining a sub-system trust score (that is, trust score of a sub-system) based on an average of trust scores of individual components. Accordingly, as indicated at 722, weightage may be assigned to individual components based on relative contribution of each component to the functionality of the sub-system, and as indicated at 724, the sub-system trust score may be determined as a weighted average of trust scores of the individual components. Further, trust scores may take into account functional redundancy between two or more individual components within a sub-system. For example, a trust score of a sub-system may be higher than the trust score of each of its components if two or more components are operating in parallel such that a failure of one component can be mitigated by operation of another component. However, a trust score of a sub-system may be lower than the trust score of each of its components if two or more components are operating in series such that a failure of either component leads to a failure of the sub-system.

In some examples, a functional safety classification for the entire sub-system including the one or more individual components may be known based on information provided by a manufacturer of the sub-system. In such cases, the trust score may be based on the functional safety classification of the sub-system.

In another example, a trust score for a sub-system may be based on one or more components that have the lowest functional safety classification. For example, a trust score of a sub-system including at least one component with a lowest functional safety classification (e.g., QM) may be less than a sub-system in which all of individual components have a functional classification greater than the lowest functional safety classification. However, if the component with the lowest functional safety classification is a redundant component such that its failure alone does not cause the sub-system to fail, the trust score for the sub-system with the component having the lowest functional safety classification may be increased.

Returning to 710, if it is determined that the functional safety classification for each sub-system is not known, method 700 proceeds to 712. At 712, method 700 includes determining a sub-system trust score based on functional safety of the individual components with known functional safety classification and based on a function of number of components with unknown functional safety classification and contribution of the individual components with unknown functional safety classification to the functionality of the sub-system. For example, weightage may be assigned to each individual component based on contribution of the individual component to the function of the sub-system. Subsequently, at 716, a first sub-system trust score may be determined based on a weighted average of the trust scores (determined based on functional safety classification) of individual components. Further, at 718, the first sub-system trust score may be adjusted based on a number of individual components with unknown functional safety classification and estimated contribution of the components with unknown functional safety classification. For example, as a number of components with unknown functional safety classification increases, the trust score may decrease.

Upon determining trust scores for each individual component and each sub-system within the vehicle system, method 700 may return to step 608 at FIG. 6 to store the generated trust scores in the look-up table. In this way, trust score for one or more individual components and/or one or more sub-systems with a vehicle may be determined based on functional safety classification of the individual components and/or sub-systems.

Figure 8:
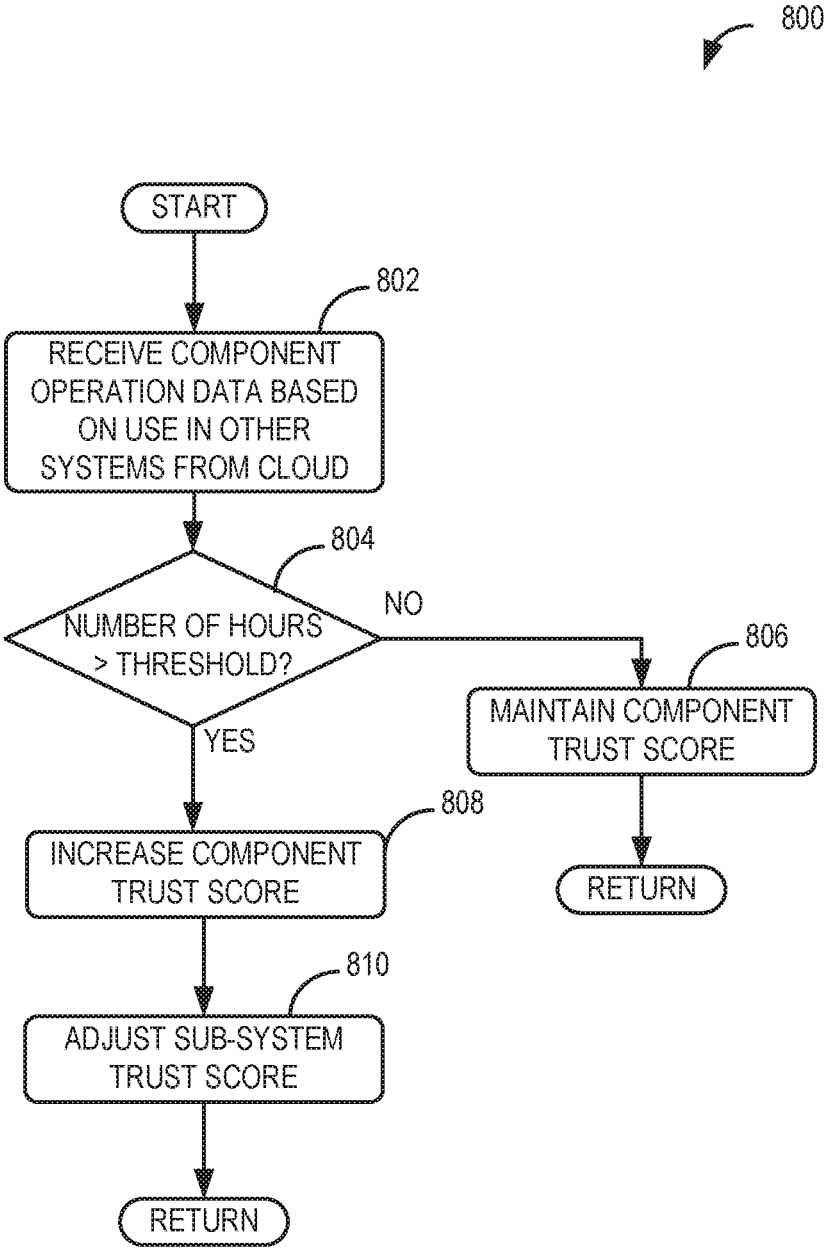
FIG. 8 is a flow chart of an example method for updating trust scores in accordance with one or more embodiments of the present disclosure.

FIG. 8 shows a flow chart illustrating an example method 800 for updating trust scores of each individual component and each sub-system of a vehicle system. Method 800 may be implemented by a trust score determination module, such as trust score determination module 400 at FIG. 4. In one example, may be implemented by trust score updater, such as trust score updater 424 at FIG. 4. Method 800 may be performed during the vehicle operation. Thus, method 800 may be implemented as a part of the second phase of trust score determination. Method 800 will be described with reference to FIG. 4 and trust score determination module 400, but it should be understood that similar methods may be implemented by other systems without departing from the scope of this disclosure.

Method 800 begins at 802. At 802, method 800 includes receiving component operation data providing indication of operation of one or more sub-systems of the vehicle represented in the trust score look up table and/or operation of one or more components that may be included within one or more sub-systems. Component operation data for a sub-system may be a cumulative number of hours of accumulated subsystem operation in a vehicle fleet, each vehicle in the fleet including the sub-system. Component operation data may be received from a cloud server storing a number of hours of operation of the one or more sub-systems or components that are used in one or more other vehicle systems. The number of hours of operation may be a cumulative number of hours of operation of the sub-system in each of the one or more other vehicle systems and the vehicle system, and may indicate a number of hours of operation without failure. For example, a first sub-system of a vehicle may include a first component and a second component. The first component of the first sub-system may be utilized in each of a plurality of vehicles (e.g., a fleet of vehicles). The first component may be in operation for a first number of hours without failure in the first vehicle. The first component may be in use for a second number of hours without failure in each of the plurality of vehicles. Each vehicle, including the first vehicle and the plurality of vehicles, may send data indicating a respective number of hours of operation of the first component to a cloud system via its respective extra-vehicle communication system. The cloud system may determine a cumulative number of hours of operation for the first component based on the number of hours in each vehicle system. As an example, the cumulative number of hours for the first component may be a sum of number of hours of operation of the first component in the vehicle fleet, e.g., 10 million hours of accumulated subsystem operation in the total vehicle fleet.

Component operation data based on usage in one or more other systems may be received by a component operation data collector, such as component operation data collector 417, within the trust score determination module. Upon receiving the component operation data, method 800 may include at 804, determining, for one or more sub-systems and/or components that are used in one or more other vehicles, if a cumulative number of hours as indicated by data received from the cloud system is greater than a threshold number. In one example, the threshold number of hours may be based on a number of hours required to classify a component as "proven in use". Further, the threshold number may vary based on a functional safety requirement for the individual component or sub-system. For example, if a functional safety requirement for a component or sub-system is higher, the threshold number may be greater.

If the answer at 804 is YES, the one or more sub-systems and/or components have been operating without failure (or mal-function) for the cumulative number of hours, which is greater than the threshold number. Thus, the one or more systems and/or components with cumulative number of hours greater than the threshold can be trusted to a greater extent. Accordingly, method 800 proceeds to 808. At 808, method 800 includes increasing a trust score for the component and/or sub-system with cumulative number of hours greater than a threshold. Next, if a trust score is increased for a component within a sub-system, method 800 may further include, at 810, adjusting sub-system trust score of the sub-system including the component. For example, adjusting sub-system trust score may be based on updated trust scores of the components of the sub-system. That is, if a trust score of a component within a sub-system is increased, a sub-system trust score of the sub-system including the component may also correspondingly increase. The updated trust score for the individual component or sub-system may be stored in the trust score look up table. Further, during vehicle-to-vehicle communication, the updated trust score may be broadcasted.

Returning to 804, if the answer is NO, method 800 proceeds to 806. At 806, method 800 includes maintaining a current sub-system trust score. Subsequently, method 800 may end. In this way, depending on the cumulative number of hours of operation of components in a vehicle fleet, the trust score may be increased.

Figure 9:
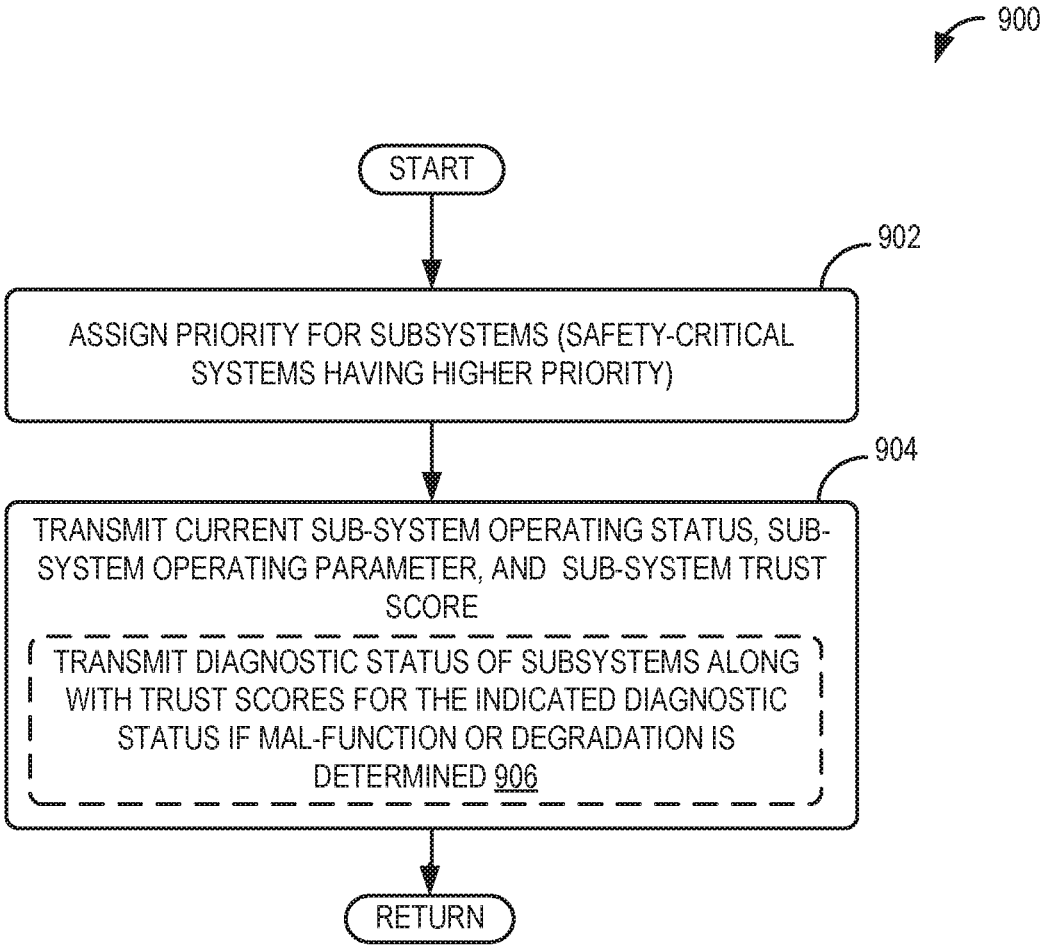
FIG. 9 is a flow chart of an example method for broadcasting trust scores in accordance with one or more embodiments of the present disclosure.

FIG. 9 shows an example flow chart illustrating an example method 900 for transmitting data, including sub-system operation data and sub-system trust score, from a vehicle system during vehicle operation (e.g., vehicle ON conditions) to one or more other vehicle system within a threshold radius of the vehicle system. The vehicle and the one or more other vehicles may be communicating via vehicle—to—vehicle communication (e.g., DSRC). Method 900 may be implemented by a trust score uploader module, such as trust score uploader module 470. Trust score data uploader 470 may provide trust score data files to a cloud server, such as ADAS cloud server, or to one or more other vehicles over any suitable extra-vehicle communication system. In some examples, user-specific information may only be transmitted if the user provides approval and/or if the information is encrypted and able to be sent over a communication link having a particular level of security.

Method 900 begins at 902. At 902, method 900 includes assigning priority to one or more components and/or sub-systems of a vehicle system, where each of the one or more sub-systems are indicated in a trust score look up table within a trust score determination module, such as trust score determination module 400, and have an associated trust score. Assigning priority to the sub-systems may be based on a criticality of a sub-system towards functional safety. For example, safety critical systems, such as electronic throttle control systems, braking systems, steering systems etc., may be assigned higher priority. Further, sub-systems with mal-function indication or having imminent risk of failure may also be assigned higher priority.

Upon assigning priority, method 900 proceeds to 904. At 904, method 900 includes transmitting vehicle operation data comprising operation data for one or more components and/or sub-systems within the vehicle may be transmitted. The operation data for one or more components and/or sub-systems may include a component/subsystem operating status (e.g., actuated, active, activation imminent, inactive, etc.), a component/subsystem operating parameter (e.g., vehicle speed, current acceleration, trajectory, yaw rate, brake pressure, etc.), and a trust score associated with each of the component/subsystem operating status and parameter. For example, for a braking system, the sub-system operating status may indicate whether braking is activated; the sub-system operating parameter may indicate an amount of braking; and the sub-system trust score may indicate a trustworthiness of the braking system. Further, in some examples, as shown at 906, additionally, responsive to detecting degradation or failure of one or more components and/or subsystems, diagnostic data indicating degradation or failure of the one or more components and/or subsystems within the vehicle may be transmitted along with trust scores for the diagnostic data indicating reliability of the diagnostic data.

Figure 10A:
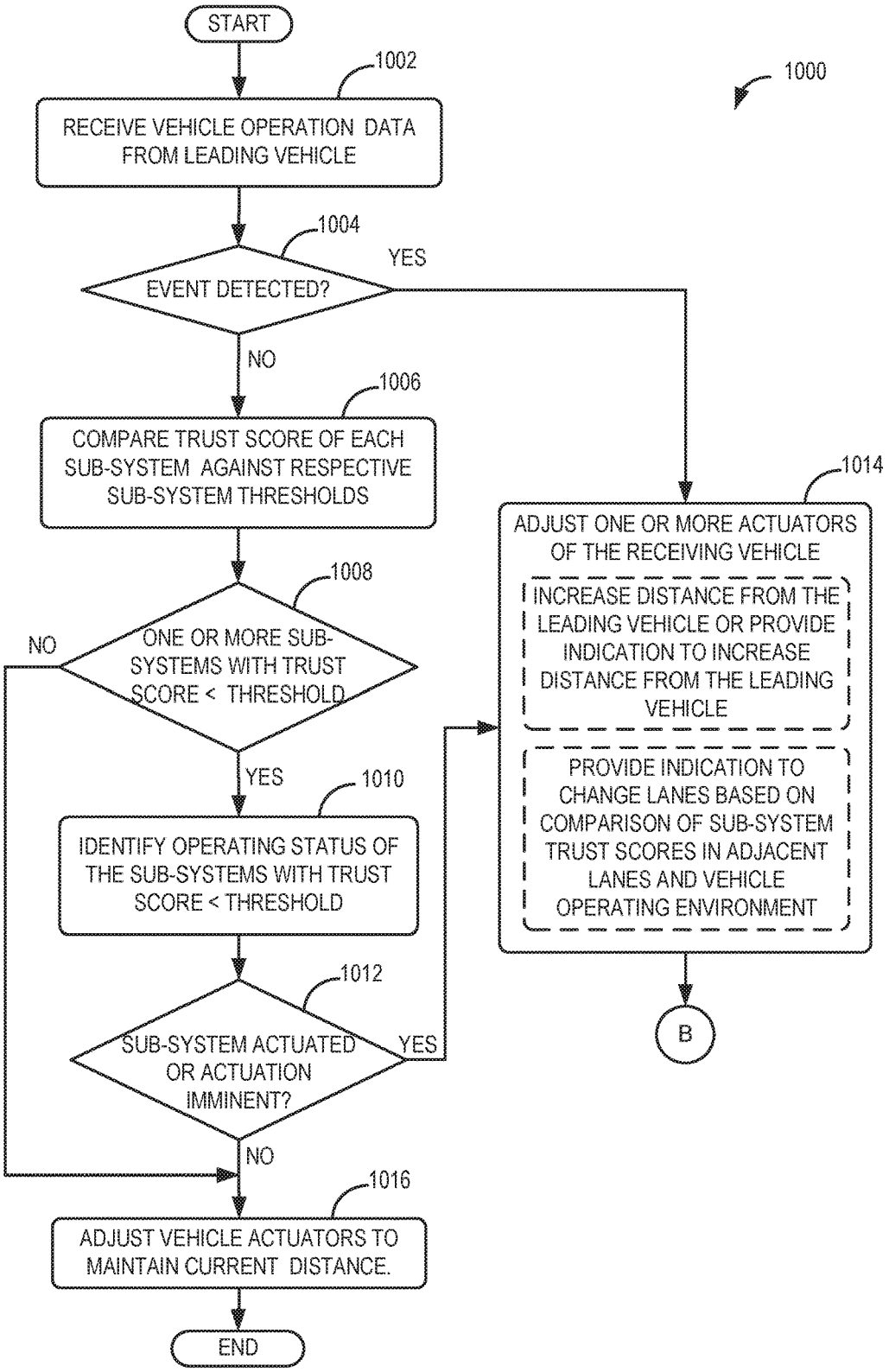
FIG. 10A is a flow chart of an example method for adjusting vehicle operation based on received trust scores in accordance with one or more embodiments of the present disclosure.
Figure 10B:
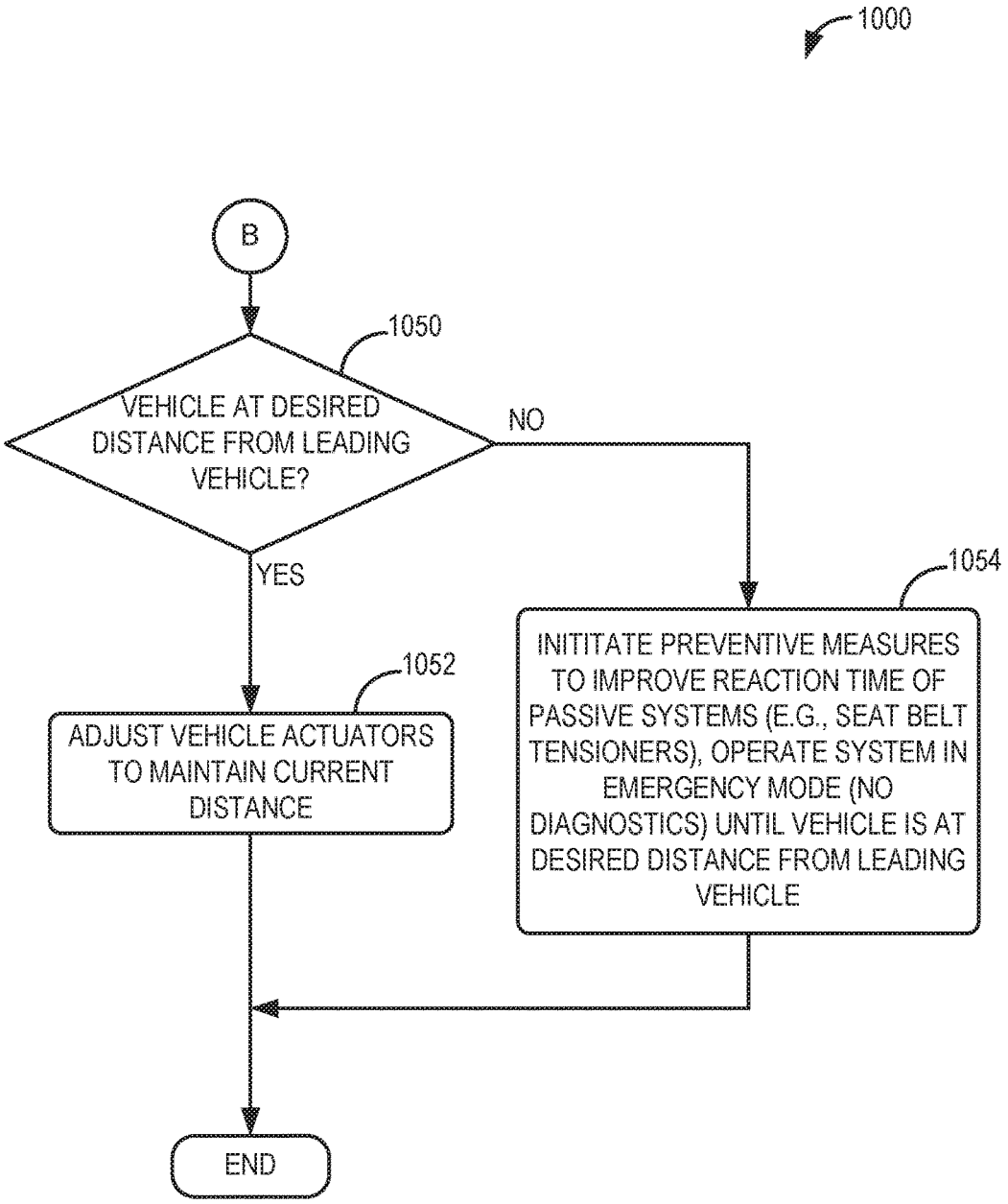
FIG. 10B is a continuation of flow chart illustrated at FIG. 10A.

Turning now to FIGS. 10A and 10B, a flowchart showing an example method 1000 for adjusting operation of a trailing vehicle receiving a leading vehicle operation data from a leading vehicle and transmitting a second vehicle operation data is shown. Specifically, method 1000 illustrates adjustment of operation of the trailing vehicle based on the leading vehicle operation data. FIG. 10B is a continuation of method 1000 of FIG. 10A. In this example, the leading vehicle may be travelling in front of the trailing vehicle in a same lane and separated by a current distance from the trailing vehicle. Method 1000 may be implemented by a trust score analysis module, such as trust score analysis module 500 at FIG. 5, of the trailing vehicle. Method 1000 will be described with reference to FIG. 5 and trust score analysis module 500, but it should be understood that similar methods may be implemented by other systems without departing from the scope of this disclosure.

Method 1000 begins at 1002. At 1002, method 1000 includes receiving leading vehicle operation data via an extra vehicle communication system, such as extra vehicle communication system 224, 344 or 444. The leading vehicle operation data may include an operating status, an operating parameter, and an associated trust score for one or more components and/or sub-systems of the leading vehicle.

Next, at 1004, method 1000 includes determining if one or more events are detected at the leading vehicle. The determination of one or more events occurring in the leading vehicle may be based on the leading vehicle operation data. Events may include sensor inconsistencies, actuator operation inconsistencies, and sub-system performance inconsistencies. Events may also include failure and/or or degradation greater than threshold of one or more individual components within a sub-system and/or sub-systems of the leading vehicle. Indication of events may be transmitted by the leading vehicle along with trust score of the information providing the indication of events.

At 1004, if one or more events are detected, method 1000 proceeds to 1014. At 1014, method 1000 includes adjusting one or more actuators (e.g., brakes, drive train, steering) of the trailing vehicle to control a longitudinal and/or lateral movement of the vehicle. Adjusting one or more actuators may include, at 1015, increasing actuation of a brake pedal to reduce vehicle speed and thereby, increase the distance from the leading vehicle. As an example, the leading vehicle and the trailing vehicle may be separated by a first threshold distance. Upon detecting one or more events based on the data received from the leading vehicle, the separation may be increased to a second threshold distance. In some examples, as indicated at 1017, additionally or alternatively, adjusting one or more actuators may include adjusting a steering wheel position to change lanes. Responsive to detecting one or more events, the trust score analysis module may send a data to the fusion and control module indicating a suitable course of action. The fusion and control module may then execute the suitable course of action (such as reducing speed, increasing braking, etc.) via one or more actuators. Additionally, in some examples, a visual message may be delivered to the vehicle operator via a user interface coupled to a head unit indicating a suitable course of action (such as, change lanes or increase distance from leading vehicle etc.).

In some examples, when one or more additional vehicles are present in the adjacent lanes within a threshold radius, the decision to change lanes may be based on trust scores of one or more vehicle in the adjacent lanes.

In some examples, additionally, adjusting one or more actuators of the trailing vehicle to control the longitudinal and/or lateral movement may be based on a strength of a communication link, such as a wireless communication link (e.g., DSRC, BLUETOOTH, WIFI/WIFI-direct, near-field communication, etc.) between the trailing vehicle and the leading vehicle, and an integrity of the data transmitted via the communication link. For example, if the strength of the communication link is less than a threshold, a threshold separation between the leading vehicle and the trailing vehicle may be increased.

If one or more events are not detected, method 1000 proceeds to 1006. At 1006, method 1000 includes comparing each received trust score of the leading vehicle against a respective threshold. The threshold may vary for each sub-system and may be based on a safety-critical aspect of the sub-system. For example, safety critical sub-systems such as electronic throttle control, steering system, braking system, drivetrain system, air bag system, etc., may have a higher threshold than a redundant sensor sub-system, failure of which may not cause an overall system failure that may lead to a hazardous situation. In some examples, additionally, thresholds may be further adjusted based on environmental conditions. For example, thresholds may be increased if slippery road conditions are detected.

Next, at 1008, method 1000 includes determining if one or more sub-systems of the leading vehicle have a trust score less than its respective threshold. As indicated above, threshold may vary based on the sub-system. If the answer at 1008 is NO, method 1000 proceeds to step 1016. At 1016, method 1000 includes adjusting one or more actuators of the trailing vehicle to maintain a current distance from the leading vehicle.

Returning to 1008, if the answer is YES, method 1000 proceeds to 1010. At 1010, method 1000 includes determining operating status of the one or more sub-systems with trust score less than the respective threshold. Next, method 1000 proceeds to 1012. At 1012, method 1000 includes determining if the one or more sub-systems with threshold less than the respective threshold are actuated or if actuation is imminent.

If the answer at 1012 is YES, method 1000 proceeds to 1014 to adjust one or more actuators to increase distance from the leading vehicle and/or to change lanes as discussed above. If the answer at 1012 is NO, method 1000 proceeds to 1016 to adjust one or more actuators of the trailing vehicle to maintain the current distance from the leading vehicle. Subsequently, method 1000 may end.

Returning to 1014, upon adjusting one or more actuators of the trailing vehicle to increase distance from the leading vehicle and/or changing lanes, method 1000 proceeds to 1050. Step 1050 is shown at FIG. 10B which is a continuation of FIG. 10A. At 1050, method 1000 includes determining if the trailing vehicle is at a desired distance from the leading vehicle. If the answer at 1050 is YES, method 1000 proceeds to 1052 to adjust one or more actuators of the trailing vehicle to maintain current distance from the leading vehicle. However, if the answer at 1050 is NO, method 1000 proceeds to 1054. At 1054, method 1000 includes adjusting one or more actuators of the trailing vehicle to initiate preventive measures, such as increasing a reacting time of seat belt tensioners and operating the trailing vehicle system in an emergency mode, until the desired distance is achieved. Operating the vehicle trailing vehicle system in emergency mode may include not performing routine diagnostic procedures. In some examples, the vehicle operator may be indicated that the vehicle is operating in the emergency mode via a visual interface, for example. The vehicle operator may be provided with the option of exiting the emergency mode at any instance, by actuation of a switch, for example.

The above example shows adjustment of operation of the trailing vehicle based on trust score data received from the leading vehicle. It will be appreciated that in some examples, the trailing vehicle may receive one or more other trust score data from one or more other vehicles. The trailing vehicle may adjust its operating parameters (e.g., vehicle speed, braking etc.) based on comparison of the trust score data from the leading vehicle and the one or more other trust score data from the one or more other vehicles. Accordingly, in one example, a method for an advanced driver assistance system for a vehicle may include receiving a first trust score data from a first vehicle operating in a same lane as the vehicle. The first trust score data may include a first trust score for a first sub-system of the first leading vehicle. The method may further include receiving a second trust score data from a second vehicle operating in an adjacent lane within a threshold radius from the vehicle, the second trust score data including a second trust score for a corresponding sub-system of the second vehicle. During a first condition when the first trust score is greater than a threshold and the second trust score is greater than the threshold, the method may include adjusting one or more actuators of the vehicle to maintain a threshold separation between the vehicle and the first vehicle. During a second condition, when the first trust score is less than the threshold and the second trust score is greater than the threshold the method may include adjusting the one or more actuators of the vehicle to move the vehicle from the same lane to the adjacent lane and maintain the threshold separation between the vehicle and the second vehicle. The first trust score is based on a first functional safety classification of the first sub-system and the second trust score based on a second functional safety classification of the corresponding sub-system. The first and the second functional safety classifications are based on a functional safety standard (e.g., ISO 26262) employed during development of the first and second vehicles. The first and the second vehicles may be manufactured by a common manufacturer or different manufacturers. In one example, the first sub-system and the corresponding system may be any one of a safety-critical system (e.g., a braking sub-system, a drivetrain sub-system). In another example, the first sub-system and the corresponding sub-system may be an ADAS sensor sub-system or a navigation sub-system.

In some examples, the trailing vehicle may receive trust scores of a plurality of sub-systems from the leading vehicle and trust scores of a plurality of sub-corresponding systems from the one or more other vehicles. A controller of the trailing vehicle may compare the trust scores of the plurality of sub-systems of the leading vehicle with the trust scores of the plurality of corresponding sub-systems of the one or more other vehicles. The controller of the trailing vehicle may determine a control action based on the comparison and accordingly, adjust one or more actuators of the trailing vehicle. The plurality of sub-systems may include safety-critical sub-systems.

Further, it will be appreciated that embodiments where the leading vehicle may receive vehicle operation data and the associated trust scores from the trailing vehicle are also within the scope of the present disclosure. Based on the trailing vehicle operation data and the associated trust scores, a control system within the leading vehicle may adjust one or more actuators of the leading vehicle to adjust a separation between the leading vehicle and the trailing vehicle. For example, if a trust score of a safety-critical sub-system of the trailing vehicle is less than a threshold, the leading vehicle may increase its vehicle speed to increase the separation between the leading vehicle and the trailing vehicle.

Figure 11:
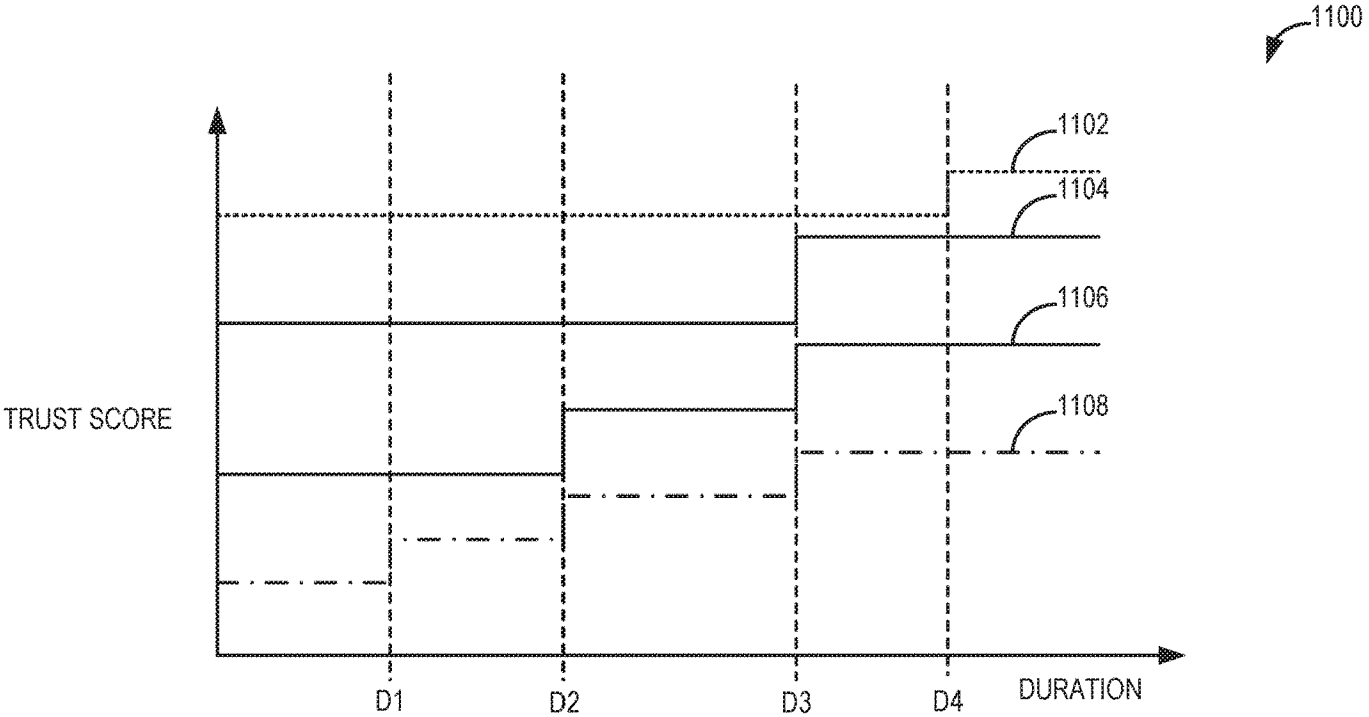
FIG. 11 is a graph illustrating an example update of trust scores in accordance with one or more embodiments of the present disclosure.

FIG. 11 shows an example graph 1100 illustrating change in trust scores of a first component, a second component, a third component and a fourth component within a first vehicle system based on cumulative duration of operation each component. The cumulative duration of operation of each component may be based on operation of similar components (same specification and same manufacturer) installed in a plurality of other vehicles.

Graph 1100 represents trust scores along the Y-axis versus duration of cumulative operation along X-axis. Trust score increase in the direction of Y-axis and the duration increases in the direction of X-axis. Graph 1100 includes plot 1102 illustrating change in a first trust score of the first component, plot 1104 illustrating change in a second trust score of the second component, plot 1106 illustrating change in a third trust score of the third component and plot 1108 illustrating change in a fourth trust score of the fourth component. The first component may be developed according to functional safety classification of ASIL A, the second component may be developed according to functional safety classification of ASIL B, the third component may be developed according to functional safety classification of ASIL C, and the fourth component may be developed according to functional safety classification of ASIL D. Therefore, the first component may have a first trust score lower than the second, the third, and the fourth trust scores.

Durations D1, D2, D3, and D4 represent first, second, third, and fourth threshold durations. The threshold durations may be based on functional safety classification and may represent threshold durations to increase a trust score of a component or a sub-system based on cumulative duration of operation. Thus, in order to increase a trust score of a component or a sub-system with ASIL A classification, the component may be determined to be operating without degradation indication or malfunction or unexpected events or failure for the first threshold duration. Similarly, in order to increase a trust score of a component or a sub-system with ASIL B, C, or D classification, the component may be determined to be operating without degradation indication or malfunction or unexpected events or failure for the second, third, and fourth threshold durations respectively. Therefore, as a functional safety classification of a component increases, the threshold duration to increase trust score also increases.

As shown, the first component may be determined to be operating in a plurality of vehicle without degradation indication or malfunction indication for the first threshold duration (e.g., 10 million hours). Responsive to which, the trust score of the first component may increase. However, the fourth trust score may be increased only when it is determined that the fourth component has operated for the fourth threshold duration (e.g., 5 billion hours) which is greater than the first threshold duration without degradation indication or malfunction indication. In this way, trust scores may be determined and adjusted based on functional safety classification and cumulative duration of operation of components.

The systems and methods described above also provide for a vehicle system comprising one or more sub-systems including one or more components; an inter-vehicle communication system configured to receive and transmit information between the vehicle and one or more other vehicles; an in-vehicle computing system including a processor and a storage device, the storage device storing functional safety classification data and instructions executable by the processor to: determine trust scores for the one or more sub-systems based on a functional safety classification of the sub-system, and store the determined trust score in the storage device; and broadcast the trust scores of the one or more sub-systems to the one or more other vehicles via the inter-vehicle communication system. In a first example of the vehicle system, the system may additionally or alternatively include wherein the one or more components include at least one of one or more sensors and one or more actuators within the vehicle; and wherein the instructions are further executable to broadcast a sub-system operation data for each of the one or more sub-systems along with the trust score for each sub-system, the sub-system operation data including a sub-system operating status indicating an activity of the sub-system, and a sub-system operating parameter. A second example of the vehicle system optionally includes the first example, and further includes wherein the instructions are further executable to responsive to determination of degradation of at least one sub-system of the one or more sub-systems, broadcast a sub-system diagnostic data of the at least one sub-system along with a diagnostic data trust score for the at least one sub-system. A third example of the vehicle system optionally includes one or more of the first and the second examples, and further includes wherein determining the trust scores for the one or more sub-systems based on the functional safety classification includes determining, for each of the one or more sub-systems, a component trust score for each component of sub-system, the component trust score based on a functional safety classification of each component. A fourth example of the vehicle system optionally includes one or more of the first through the third examples, and further includes wherein the trust score of a sub-system is higher than the component trust score of each of its components if two or more components are operating in parallel such that a failure of one component can be mitigated by operation of another component. A fifth example of the vehicle system optionally includes one or more of the first through the fourth examples, and further includes wherein the trust score of a sub-system is lower than the component trust score of each of its components if two or more components are operating in series such that a failure of either component leads to a failure of the sub-system. A sixth example of the vehicle system optionally includes one or more of the first through the fifth examples, and further includes wherein the instructions are further executable to when a functional safety classification of at least one component of a subsystem is not known, determine the trust score of the sub-system based on whether the at least one component is proven in use based on a number of hours of accumulated component operation of similar components in a plurality of vehicles. A seventh example of the vehicle system optionally includes one or more of the first through the sixth examples, and further includes wherein the instructions are further executable to update the trust scores for each sub-system based on a number of hours of operation of each sub-system in the vehicle and a total number of hours of operation of similar sub-systems in a plurality of vehicles. An eighth example of the vehicle system optionally includes one or more of the first through the seventh examples, and further includes wherein the instructions are further executable to receive one or more trust score data from the one or more other vehicles, the one or more trust score data including trust scores for each of one or more other sub-systems within the one or more other vehicles; and adjust the one or more actuators of the vehicle based on the received trust score data, the one or more actuators including at least one of one or more braking actuators and one or more drivetrain actuators of the vehicle. A ninth example of the vehicle system optionally includes one or more of the first through the eighth examples, and further includes wherein the one or more sub-systems is at least one of a braking system and a drivetrain system. A tenth example of the vehicle system optionally includes one or more of the first through the ninth examples, and further includes wherein the one or more components further include one or more processors; and wherein the trust score for each of the one or more sub-systems is further based on a processor trust score of each of the one or more processors, the processor trust score of each processor based on a functional safety classification of each processor.

The systems and methods described above also provide for a vehicle system comprising one or more sub-systems including one or more sensors and one or more actuators; an inter-vehicle communication system configured to receive and transmit information between the vehicle and a second vehicle; an in-vehicle computing system including a processor and a storage device, the storage device storing a first trust score data including a first trust score for the one or more sub-systems and instructions executable by the processor to: receive a second trust score data from the second vehicle via the inter-vehicle communication system, the second trust score data including a second trust score for one or more second sub-systems of the second vehicle; and adjust one or more actuators of the vehicle system based on the received second trust score data; wherein the first trust score and the second trust score are based on functional safety classifications of the one or more sub-systems and the one or more second sub-systems respectively. In a first example of the vehicle system, the system may additionally or alternatively include wherein the instructions are further executable to transmit the first trust score data via the inter-vehicle communication system; transmit a first sub-system operation data including a first sub-system operating status, a first sub-system operating parameter, and a first sub-system diagnostic status of each of the one or more sub-systems to the second vehicle via the inter-vehicle communication system; and receive a second sub-system operation data, the second sub-system operation data including a second sub-system operating status, a second sub-system operating parameter and a second sub-system diagnostic status of each of the one or more second sub-systems from the second vehicle via the inter-vehicle communication system. A second example of the vehicle system optionally includes the first example, and further includes wherein the second vehicle system is a trailing vehicle operating behind the vehicle in a same lane. A third example of the vehicle system optionally includes one or more of the first and the second examples, and further includes wherein adjusting the one or more actuators of the vehicle based on the received second trust score data includes in response to at least one of the second trust scores below a threshold, adjusting one or more drivetrain actuators to increase a distance between the vehicle and the second vehicle. A fourth example of the vehicle system optionally includes one or more of the first through the third examples, and further includes wherein the second vehicle system is a leading vehicle travelling in front of the vehicle in a same lane; and wherein adjusting the one or more actuators of the vehicle based on the received second trust score data includes in response to at least one of the second trust scores below a threshold, adjusting one or more braking actuators to increase a distance between the vehicle and the second vehicle. A fifth example of the vehicle system optionally includes one or more of the first through the fourth examples, and further includes wherein the inter-vehicle communication system is further configured to receive and transmit information between the vehicle and a third vehicle traveling ahead of the vehicle in an adjacent lane; and wherein the instructions are further executable to: receive a third trust score data from the third vehicle, the third trust score data including a third trust score for each of one or more sub-systems of the third vehicle; compare the second trust scores of a first subset of the sub-systems of the second vehicle with the third trust scores of a second subset of the sub-systems of the third vehicle, the second subset corresponding to the first subset; and adjust one or more actuators of the vehicle based on the comparison. A sixth example of the vehicle system optionally includes one or more of the first through the fifth examples, and further includes wherein the first subset includes one or more safety-critical systems of the second vehicle, and the second subset includes corresponding safety-critical systems of the third vehicle. A seventh example of the vehicle system optionally includes one or more of the first through the sixth examples, and further includes wherein the vehicle is developed by a first manufacturer, the second vehicle is developed by a second manufacturer, and the third vehicle is developed by a third manufacturer, the first manufacturer different from the second manufacturer and the third manufacturer different from the first and the second manufacturers.

The systems and methods described above also provide for a method for an advanced driver assistance system for a vehicle. The method comprising receiving a first trust score data from a first leading vehicle operating in a same lane as the vehicle, the first trust score data including a first trust score for a first sub-system of the first leading vehicle; receiving a second trust score data from a second vehicle operating in an adjacent lane, the second trust score data including a second trust score for a corresponding sub-system of the second vehicle; during a first condition when the first trust score is greater than a threshold and the second trust score is greater than the threshold, adjusting one or more actuators of the vehicle to maintain a threshold separation between the vehicle and the first vehicle; and during a second condition when the first trust score is less than the threshold and the second trust score is greater than the threshold, adjusting the one or more actuators of the vehicle to move the vehicle from the same lane to the adjacent lane and maintain the threshold separation between the vehicle and the second vehicle; wherein the first trust score is based on a first functional safety classification of the first sub-system; wherein the second trust score based on a second functional safety classification of the corresponding sub-system, the first and the second functional safety classifications based on a functional safety standard employed during development of the first and second vehicles.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices, such as the in-vehicle computing system 101, 151 described with reference to FIG. 1 and/or in-vehicle computing system 212 described with reference to FIG. 2, in combination with navigation system 228 described with reference to FIG. 2. The methods may be performed by executing stored instructions with one or more logic devices (e.g., processors) in combination with one or more additional hardware elements, such as storage devices, memory, hardware network interfaces/antennas, switches, actuators, clock circuits, etc. The described methods and associated actions may also be performed in various orders in addition to the order described in this application, in parallel, and/or simultaneously. The described systems are exemplary in nature, and may include additional elements and/or omit elements. The subject matter of the present disclosure includes all novel and non-obvious combinations and sub-combinations of the various systems and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

The invention claimed is:

1. A vehicle system comprising:

one or more sub-systems including one or more components;

an inter-vehicle communication system configured to receive and transmit information between a vehicle and one or more other vehicles;

an in-vehicle computing system including a processor and a storage device, the storage device storing functional safety classification data and instructions executable by the processor to:

determine first trust scores for the one or more sub-systems based on a functional safety classification of the sub-system, the functional safety classification based on a functional safety standard;

broadcast the first trust scores of the one or more sub-systems to the one or more other vehicles via the inter-vehicle communication systems;

receive second trust score data from a second vehicle via the inter-vehicle communication system, the second trust score data including a second trust score for one or more second sub-systems of the second vehicle, wherein the second trust score is based on the functional safety standard and indicates reliability of information or data output by each of the one or more second sub-systems; and adjust one or more actuators of the vehicle system based on the received second trust score data, wherein adjusting the one or more actuators of the vehicle system based on the received second trust score data includes, in response to at least one of the second trust scores below a threshold, adjusting one or more drivetrain actuators to increase a distance between the vehicle and the second vehicle, and wherein the first trust scores and the second trust score have enumerated or integer values to reflect a risk classification scheme of the functional safety standard.

2. The vehicle system as in claim 1, wherein the one or more components include at least one of one or more sensors and one or more actuators within the vehicle; and wherein the instructions are further executable to broadcast a sub-system operation data for each of the one or more sub-systems along with the first trust score for each sub-system, the sub-system operation data including a sub-system operating status indicating an activity of the sub-system, and a sub-system operating parameter.

3. The vehicle system as in claim 2, wherein the instructions are further executable to adjust one or more braking actuators of the vehicle based on the received second trust score data.

4. The vehicle system as in claim 1, wherein the instructions are further executable to, responsive to determination of degradation of at least one sub-system of the one or more sub-systems, broadcast a sub-system diagnostic data of the at least one sub-system along with a diagnostic data trust score for the at least one sub-system.

5. The vehicle system as in claim 1, wherein determining the first trust scores for the one or more sub-systems based on the functional safety classification includes determining, for each of the one or more sub-systems, a component trust score for each component of sub-system, the component trust score based on a functional safety classification of each component.

6. The vehicle system as in claim 5, wherein the first trust score of a sub-system is higher than the component trust score of each of its components if two or more components are operating in parallel such that a failure of one component can be mitigated by operation of another component.

7. The vehicle system as in claim 5, wherein the first trust score of a sub-system is lower than the component trust score of each of its components if two or more components are operating in series such that a failure of either component leads to a failure of the sub-system.

8. The vehicle system as in claim 5, wherein the instructions are further executable to, when a functional safety classification of at least one component of a subsystem is not known, determine the first trust score of the sub-system based on whether the at least one component is proven in use based on a number of hours of accumulated component operation of similar components in a plurality of vehicles.

9. The vehicle system as in claim 5, wherein the one or more components further include one or more processors; and wherein the first trust score for each of the one or more sub-systems is further based on a processor trust score of each of the one or more processors, the processor trust score of each processor based on a functional safety classification of each processor.

10. The vehicle system as in claim 1, wherein the instructions are further executable to update the first trust scores for each sub-system based on a number of hours of operation of each sub-system in the vehicle and a total number of hours of operation of similar sub-systems in a plurality of vehicles.

11. The vehicle system as in claim 1, wherein the one or more sub-systems is at least one of a braking system and a drivetrain system, wherein the functional safety classification provides an indication of functional safety standards employed during development and production of the at least one of the braking system and the drivetrain system, and wherein the second vehicle is a trailing vehicle operating behind the vehicle in a same lane.

12. A vehicle system comprising:

one or more sub-systems including one or more sensors and one or more actuators;

an inter-vehicle communication system configured to receive and transmit information between a vehicle and a second vehicle;

an in-vehicle computing system including a processor and a storage device, the storage device storing a first trust score data including a first trust score for the one or more sub-systems and instructions executable by the processor to:

receive a second trust score data from the second vehicle via the inter-vehicle communication system, the second trust score data including a second trust score for one or more second sub-systems of the second vehicle; and adjust the one or more actuators of the vehicle system based on the received second trust score data;

wherein the first trust score and the second trust score are based on functional safety classifications of the one or more sub-systems and the one or more second sub-systems respectively and wherein the first trust score and the second trust score indicate reliability of information or data output by each of the one or more sub-systems and the one or more second sub-systems, respectively, wherein the second vehicle is a leading vehicle travelling in front of the vehicle in a same lane, and wherein adjusting the one or more actuators of the vehicle based on the received second trust score data includes, in response to at least one of the second trust scores below a threshold, adjusting one or more braking actuators to increase a distance between the vehicle and the second vehicle.

13. The vehicle system as in claim 12, wherein the instructions are further executable to transmit the first trust score data via the inter-vehicle communication system, transmit a first sub-system operation data including a first sub-system operating status, a first sub-system operating parameter, and a first sub-system diagnostic status of each of the one or more sub-systems to the second vehicle via the inter-vehicle communication system; and receive a second sub-system operation data, the second sub-system operation data including a second sub-system operating status, a second sub-system operating parameter, and a second sub-system diagnostic status of each of the one or more second sub-systems from the second vehicle via the inter-vehicle communication system.

14. The vehicle system as in claim 12, wherein the inter-vehicle communication system is further configured to receive and transmit information between the vehicle and a third vehicle traveling ahead of the vehicle in an adjacent lane; and wherein the instructions are further executable to:

receive a third trust score data from the third vehicle, the third trust score data including a third trust score for each of one or more sub-systems of the third vehicle;

compare the second trust score of each sub-system of a first subset of the sub-systems of the second vehicle with the third trust score of each sub-system of a second subset of the sub-systems of the third vehicle, the second subset corresponding to the first subset; and adjust one or more actuators of the vehicle based on the comparison.

15. The vehicle system as in claim 14, wherein the vehicle is developed by a first manufacturer, the second vehicle is developed by a second manufacturer, and the third vehicle is developed by a third manufacturer, the first manufacturer different from the second manufacturer and the third manufacturer different from the first and the second manufacturers.

16. A method for an advanced driver assistance system for a vehicle, comprising:

receiving a trust score data from a leading vehicle operating in a same lane as the vehicle, the trust score data including a first trust score for a first sub-system of the leading vehicle;

during a first condition when the first trust score is greater than a threshold, adjusting one or more actuators of the vehicle to maintain a first threshold separation between the vehicle and the leading vehicle; and during a second condition when the first trust score is less than the threshold, adjusting the one or more actuators of the vehicle to maintain a second threshold separation between the vehicle and the leading vehicle;

wherein the first trust score is based on a certified functional safety classification of the first sub-system reflecting an automotive safety integrity level of the first sub-system according to a predefined standard; and wherein the first threshold separation is shorter than the second threshold separation.

17. The method of claim 16, wherein the first trust score remains unchanged over a life of the leading vehicle.

* * * * *